US006665501B2

(12) United States Patent
Okada et al.

(10) Patent No.: US 6,665,501 B2
(45) Date of Patent: Dec. 16, 2003

(54) IMAGE FORMING APPARATUS, COMMUNICATION CONTROLLING METHOD AND STORAGE MEDIUM

(75) Inventors: Tomoyuki Okada, Shizuoka (JP); Toshiki Nakayama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/917,823

(22) Filed: Jul. 31, 2001

(65) Prior Publication Data

US 2002/0015597 A1 Feb. 7, 2002

(30) Foreign Application Priority Data

Aug. 1, 2000 (JP) ..... 2000-233749
Jan. 29, 2001 (JP) ..... 2001-019599

(51) Int. Cl.[7] ..... G03G 15/08
(52) U.S. Cl. ..... 399/27
(58) Field of Search ..... 399/27, 12, 13, 399/24

(56) References Cited

U.S. PATENT DOCUMENTS 6,137,966 A * 10/2000 Uehara et al. ..... 399/13
6,516,158 B2 * 2/2003 Saito ..... 399/12
2001/0002953 A1 * 6/2001 Sato ..... 399/284
2001/0016123 A1 * 8/2001 Yoshimura ..... 399/25

FOREIGN PATENT DOCUMENTS

JP 1-300266 * 12/1989
JP 7-64451 * 3/1995
JP 1-39717 * 2/1998

* cited by examiner

*Primary Examiner*—Quana M. Grainger
(74) *Attorney, Agent, or Firm*—Fitzpatrick, Cella, Harper & Scinto

(57) ABSTRACT

In an image forming apparatus of the tandem type, nonvolatile memories are carried on a plurality of interchangeable units to thereby realize a radio frequency memory system unrelated to the reliability of contact of a connector. By an analog switch low in rated voltage provided at the front stage of an amplification circuit, the transmission signal of a communication IC is changed over to a plurality of transmitting circuits having their outputs individually adjustable, and the reception signal of an antenna part is changed over by the analog switch, and receiving circuits are provided at the rear stage of the analog switch and made common by a circuit.

Also, communication means provided in the image forming apparatus has an amplifying means provided for each signal controlling means for controlling a communication signal, switch means for selecting one of a plurality of communication circuits after the amplifying means has amplified the communication signal, and amplitude adjusting means for attenuating the amplitude of the communication signal passed through the switch means, and communicates with the plurality of nonvolatile memories by changing over the switch means.

45 Claims, 13 Drawing Sheets

112a : AMPLITUDE ADJUSTING CIRCUIT

113 : RECEIVING CIRCUIT

131a : AUTOMATIC AMPLITUDE ADJUSTING CIRCUIT

600 : COMMUNICATION PART OF CONVENTIONAL TYPE IMAGE FORMING APPARATUS 500

IMAGE FORMING APPARATUS, COMMUNICATION CONTROLLING METHOD AND STORAGE MEDIUM

BACKGROUND OF THE INVENTION

1. Field of the Invention

This invention relates to an image forming apparatus, a communication controlling method and a storage medium, and particularly to an image forming apparatus, a communication controlling method and a storage medium suitable for application to an electrophotographic recording apparatus, an electrostatic recording apparatus or the like having expendibles such as toner cartridges or interchangeable parts such as devices to be interchanged due to their service lives.

This invention relates to an image forming apparatus such as an electrophotographic apparatus or an electrostatic recording apparatus having expendibles such as toner cartridges or interchangeable parts such as devices to be interchanged due to their service lives.

2. Related Background Art

There have heretofore been image forming apparatus for forming an image on paper by the electrophotographic recording process or the like. FIG. 13 of the accompanying drawings schematically shows the construction of an example of an image forming apparatus of the tandem type. In the following description, a plurality of functionally equal units exist in the image forming apparatus and therefore, reference numerals designating the plurality of functionally equal units are given suffixes a, b, c and d, and in descriptions common to all units, those reference numerals will sometimes be shown with the suffixes a, b, c and d omitted therefrom.

The image forming apparatus of the tandem type is comprised of a plurality of image forming portions including black (Bk), yellow (Y), magenta (M) and cyan (C). In each image forming portion, the reference numeral 18 designates a photosensitive drum (image bearing body) made of an organic photosensitive body or an amorphous silicon photosensitive body, and the photosensitive drum 18 is subjected to the uniform charging process of predetermined polarity and potential by a charging device 16 such as a charging roller in the rotating process thereof. A scanner unit 11 outputs a laser beam 13 modulated correspondingly to an image signal of desired image information from an image signal generating unit such as an image reading apparatus, not shown, and scans it on the photosensitive drum 18 by a deflecting mirror, not shown, through an optical lens system, not shown, whereby an electrostatic latent image is formed on the surface of the photosensitive drum.

FIG. 14 of the accompanying drawings is a perspective view showing the construction of the scanner unit 11 of each image forming portion of the above-described image forming apparatus. The operation of the scanner unit 11 will hereinafter be described with reference to FIG. 14. The reference numeral 31 denotes a semiconductor laser, the reference numeral 32 designates a collimator lens, the reference numeral 33 denotes a cylindrical lens, the reference numeral 34 designates a polygon mirror, the reference numeral 35 denotes a scanner motor, the reference numeral 36 designates a spherical lens, the reference numeral 37 denotes an fθ lens, the reference numeral 38 designates a deflecting mirror, and the reference numeral 39 denotes a horizontal synchronizing signal detector.

The semiconductor laser 31 emits light by a laser driving signal modulated on the basis of the image signal, and the laser beam is shaped into a beam shape by the collimator lens 32 and the cylindrical lens 33. The polygon mirror 34 is rotated by the steadily rotating scanner motor 35, and the laser beam reflected by the surface of the polygon mirror is scanned in a fan-shape. Further, the laser beam is shaped by optical lens units such as the spherical lens 36, the fθ lens 37 and the deflecting mirror 38 and also scans the surface of the photosensitive drum at constant velocity. The horizontal synchronizing signal detector 39 is generally comprised of a photodiode and an amplifier, and detects the scanned laser beam and generates a synchronizing signal in a main scanning direction.

Further, FIG. 13 will be described. The reference numeral 14 designates a developing device which contains a developer (toner) therein and has a toner carrying mechanism generally directed to the charging and carrying of the toner. The photosensitive drum 18 on which the electrostatic latent image has been formed is brought into contact with or proximity to a developing roller 17, whereby the electrostatic latent image is visualized as an image by the toner selectively adhering to the surface of the photosensitive drum in conformity with the electrostatic state thereof. The reference numeral 22 denotes a cassette containing transferring materials 29 therein. A transferring material fed from the cassette 22 by a feeding roller is conveyed between the photosensitive drum 18 and a transferring device 19 in the image forming portion by a conveying belt 20 for holding and conveying the transferring material. At this time, the toner image on the photosensitive drum 18 developed in the above-described developing process is transferred to the transferring material 29 by a transferring device 19. The image is passed through the image forming portions of four colors in succession, whereby developers of four colors are multiple-transferred.

Any residual toner on the photosensitive drum 18 which has not been transferred in this transferring process is removed and collected by a cleaning device 15 comprising a cleaning blade or the like. The reference numeral 23 designates a fixing device. The fixing device 23 is generally comprised of a plurality of rollers facing with each other, and has a heating portion such as a heater inside or outside the roller. Also, the fixing device 23 is provided with a temperature detector near the rollers, and is controlled so as to assume a predetermined temperature by monitoring temperature by a CPU or the like and controlling the heating amount of the heater. In the above-described transferring process, the transferring material 29 to which the toner has been transferred is heated and pressurized by the fixing device 23 and the toner image thereon is melted and fixed. Thereafter, the fixed transferring material 29 is conveyed through a discharging mechanism and is discharged from the image forming apparatus and thus, printing is completed.

In such an image forming apparatus, the above-described developing device 14 containing the toner is an interchangeable unit which must on occasion be interchanged due to the consumption of the toner. Such an interchangeable unit is interchanged by the user when the remaining amount of toner has been detected and the user has been informed of the detection result, or simply that it is time to exchange the unit because the toner is running low. The detection of the remaining amount of toner should more desirably be reported to the user before the toner becomes exhausted and printing becomes impossible than before the exhaustion of the toner is reported, so that the user can be prepared for the interchange of the interchangeable unit. Further, ideally, if the used amount of expendibles is always reported, the user can know precisely not only when it is time for interchange but also the used state of expendibles, and for example, this approach provides the user with information for judging whether the remaining expendibles are sufficient when a great deal of documents are to be printed. As described above, it is desirable that the used state of the interchangeable unit can be understood precisely.

However, the interchangeable unit like an article of consumption is a unit construction discrete from the main body of the image forming apparatus, and for example, when a developing device 14 used in other image forming apparatus is mounted on a discrete image forming apparatus, it is difficult to judge to what degree the developing device 14 has been used. So, a nonvolatile memory is carried on an interchangeable unit and the used amount of the interchangeable unit is cumulatively recorded in this nonvolatile memory, whereby even between different image forming apparatuses, the information of the interchangeable unit in the nonvolatile memory can be read out to thereby grasp the state of the interchangeable unit correctly and report it accurately to the user.

On the other hand, in the conventional system, there is the technique of mounting a nonvolatile memory such as EEPROM on an interchangeable unit, and connecting it to the main body of an image forming apparatus by a connector during the mounting of the interchangeable unit to thereby realize the interchange. When a nonvolatile memory is to be carried on an interchangeable unit, it is often the case that not an ordinary connector for a harness, but a drawer connector with a fitting member easily inserted and drawn out during the mounting and dismounting thereof is used. At the fitting portion, it is arranged, a guide member for absorbing the positional deviation due to the tolerance between the interchangeable unit and the main body of the apparatus during the mounting or dismounting of the interchangeable unit. The drawer connector is higher in cost than the ordinary connector for a harness.

Also, the nonvolatile memory carrying system by this drawer connector is of the contact type and therefore, bad contact may be caused, for example, by toner dust in the main body of the apparatus or dust entering from the outside, and there is a problem in the reliability of a connector contact, and this leads to the limitation that during the insertion and drawing-out of the connector, the contact need be formed by a self-cleaned slidable contact.

From such a point of view, there has been desired a nonvolatile memory system by the non-contact between the main body of the apparatus and the nonvolatile memory. So, in recent years, there has been devised a memory system capable of effecting non-contact communication which uses a nonvolatile-memory such as an FeROM or an FeRAM. This system is a system which is comprised of a transmitting circuit and a receiving circuit and in which generally from the transmitting circuit, data is superimposed on a carrier wave called a carrier and the electric power of the nonvolatile memory is supplied by the carrier and also the data is transmitted and received. The transmitting circuit is comprised of an antenna, and the nonvolatile memory side is also comprised of an antenna. The transmitting side antenna of the main body of the apparatus is driven by the above-mentioned carrier, and the antenna of the interchangeable unit side memory unit opposed thereto in non-contact is electromagnetically induced by an electromagnetic wave, whereby electric power is supplied to the memory unit. In this system, the problem regarding the reliability of the connector contact which has been the drawback of the nonvolatile memory carrying system of the contact type can be avoided.

FIG. 15 of the accompanying drawings is a circuit diagram of a communication part 600 in an image forming apparatus of the conventional type.

The communication part 600 is a circuit necessary for the communication of a memory of one channel.

A communication IC 105 effects communication with a memory unit 101 on the basis of information designated from a CPU or a logic IC, not shown. Also, the communication IC 105 superimposes the address, command and data of the memory unit designated by the CPU or the logic IC upon a carrier for supplying electric power to the memory unit 101 containing a nonvolatile memory therein, and produces a transmission signal.

The transmission signal is amplified into a transmission signal having an amplitude of several tens of volts by an amplification circuit 104, and drives an antenna portion 102 through a coupling capacitor 110 and generates an electromagnetic wave to thereby supply electric power to the memory unit 101 and also transmits the superimposed data.

The inductor of the antenna portion constitutes a tuning capacitor 108 and a resonance circuit having the carrier of the signal as a resonance frequency. The memory unit returns a reception signal on the basis of the transmitted data. The reception signal is received from the antenna portion 102 by a receiving circuit 113 through a coupling capacitor 111.

Like the inductor of the transmitting portion, the inductor of the receiving portion constitutes a tuning capacitor 109 and a resonance circuit. The communication IC 105 takes out the received data from the reception signal via the receiving circuit 113, and the CPU or the logic IC, not shown, reads it out. By such a system, there is constructed the conventional system in which reading and writing can be done in non-contact with the nonvolatile memory of the interchangeable unit.

However, the communication system of this radio frequency memory requires a communication IC. This communication IC is a communication IC exclusively for the radio frequency memory and therefore, its drawback is that its cost is high. Also, this non-contact type memory communication system is comprised of a transmitting circuit and a receiving circuit, as described above and therefore, the number of the parts of the electric circuits is great, and comparing the costs of only the communication circuits, this system is higher in cost than the contact type memory communication system using EEPROM. However, if the transmitting circuit and the receiving circuit are combined into a common circuit, it will be necessary to communicate with a faraway memory, and it will be necessary to transmit a strong electromagnetic wave from the antenna. However, the outputs by electromagnetic waves are regulated by law, and it is not desirable to make the output great. Also, in order not to output an unnecessary radiation wave, it is necessary to construct the transmitting portion of the main body of the apparatus and the nonvolatile memory unit at a short distance, and communicate by a feeble electromagnetic wave.

Also, when as described above, the nonvolatile memory is mounted in the interchangeable unit of the color image forming apparatus of the tandem type, four sets of drawer connectors are necessary in the contact type nonvolatile memory system and the cost becomes high, and in addition, this is not preferable from the viewpoint of the reliability of the contact of the connector. Also, in the radio frequency type nonvolatile memory system, four communication IC's are necessary and moreover, four transmitting circuits and four receiving circuits are also necessary, and there cannot be provide an image forming apparatus of low cost. Also, when four sets of transmitting circuits and receiving circuits are constructed, the communication circuit board becomes bulky and a space therefor is necessary in the main body of the apparatus, and this has been difficult to realize. To observe the Wireless Telegraphy Act and minimize the unnecessary radiation waves, a method of suppressing the irregularity of the communication output of the transmitting circuit is necessary.

Further, in the above-described example of the prior art, among the plurality of communication circuits and among the plurality of transmitting and receiving circuits, the irregularity of the output electric power exists due to the manufacturing irregularity of elements constituting the circuits and the pattern irregularity of the board and therefore, to minimize the unnecessary radiation waves in connection with the Wireless Telegraphy Act, there is the problem that it is necessary to suppress the irregularity of the communication output of the transmitting circuit.

SUMMARY OF THE INVENTION

The present invention has been made in view of the above-noted points, and an object thereof is to provide an image forming apparatus, a communication controlling method and a storage medium in which a nonvolatile memory can be carried on each of a plurality of interchangeable units mounted on the image forming apparatus to thereby improve usability and yet improve reliability at a low cost.

It is also an object of the present invention to provide an image forming apparatus of the tandem type in which a nonvolatile memory is carried on each of a plurality of interchangeable units and a non-contact memory system unrelated to the reliability of contact of a connector can be realized at a low cost.

To achieve the above objects, the present invention provides an image forming apparatus on which a plurality of interchangeable units each provided with a nonvolatile memory are detachably mountable, characterized by changeover means for changing over a communication signal based on the radio frequency communication by an electromagnetic wave with the nonvolatile memory of each of the interchangeable units to a different communication circuit, and communication means for controlling the changeover means to thereby effect the communication with the nonvolatile memory of each of the interchangeable units.

Preferably, the interchangeable units may be units interchangeable due to the life or consumption of a developing container or the like in which a developer is contained.

Preferably, the communication means may have a plurality of amplifying means for amplifying a plurality of communication signals changed over to the different communication circuit by the changeover means.

Preferably, the communication means may have a plurality of transmitting and receiving means for effecting the transmission and reception of a signal with the nonvolatile memory of each of the interchangeable units, and second changeover means for changing over a reception signal received by each of the transmitting and receiving means.

Preferably, each of the changeover means and the second changeover means may be comprised of an analog switch.

Also, the communication controlling method according to the present invention is a communication controlling method applied to an image forming apparatus on which a plurality of interchangeable units each provided with a nonvolatile memory are detachably mountable, the method having the changing-over step of changing over a communication signal based on the radio frequency type communication by an electromagnetic wave between the main body of the image forming apparatus and the nonvolatile memory of each of the interchangeable units to a different communication circuit, and the communicating step of controlling the changing-over step to thereby effect the communication between the main body of the image forming apparatus and the nonvolatile memory of each of the interchangeable units.

Preferably, the interchangeable units may be units interchangeable due to the life or consumption of a developing container or the like in which a developer is contained.

Preferably, the communicating step may have a plurality of amplifying steps of amplifying a plurality of communication signals changed over to the different communication circuit by the changing-over step.

Preferably, the communicating step may have a plurality of transmitting and receiving steps of effecting the transmission and reception of a signal with the nonvolatile memory of each of the interchangeable units, and a second changing-over step of changing over a reception signal received by each of the transmitting and receiving steps.

Preferably, at the changing-over step and the second changing-over step, the changing-over operation is performed by an analog switch.

According to the present invention, a radio frequency memory system in which a nonvolatile memory is carried on each of a plurality of interchangeable units detachably mountable on an image forming apparatus and which is unrelated to the reliability of contact of a connector can be realized at a low cost. Further, communication means (communication IC's) which have been the drawback of the radio frequency type can be made common to thereby realize a low cost, and further, the transmitting and receiving circuits can be partly made common to thereby realize space saving and a low cost. By effecting communication with a plurality of volatile memories by a communication means (communication IC), if the number of the interchangeable units is four, the communication means (communication IC) can be realized at a quarter cost. Further, by having a plurality of communication circuits, for a plurality of transmission outputs, each of them can be adjusted to a necessary sufficient output. By the system of the present invention an image forming apparatus effective for the observation of the regulation by the Wireless Telegraphy Act and the suppression of the unnecessary radiation waves can be designed. Also the changeover means and the second changeover means (analog switchers) are constructed on this side of the receiving circuit, whereby an entirely common circuit can be used as the receiving circuits, and it becomes possible to equip the entire communication circuit with space saving. By the present invention, it becomes possible to provide a system in which a nonvolatile memory can be carried on each of a plurality of interchangeable units detachably mountable on an image forming apparatus to thereby improve the usability thereof and which is low in cost and high in reliability.

According to the present invention, it becomes possible to provide a system in which a communication controlling method is executed by an image forming apparatus, whereby as described above, a nonvolatile memory can be carried on each of a plurality of interchangeable units detachably mounted on the image bearing apparatus to thereby improve the usability of the apparatus and yet which is low in cost and high in reliability.

Also, in another image forming apparatus according to the present invention, communication means provided in the image forming apparatus has an amplifying means provided for each signal controlling means for controlling a communication signal, switch means for selecting one of a plurality of communication circuits after the amplifying means has amplified the communication signal, and amplitude adjusting means for attenuating the amplitude of the communication signal passed through the switch means, and communicates with a plurality of nonvolatile memories by changing over the switching means.

According to the present invention, in an image forming apparatus of the tandem type, there is achieved the effect that a radio frequency memory system in which a nonvolatile memory is carried on each of a plurality of interchangeable units and which is unrelated to the reliability of contact of a connector can be realized at a low cost.

Also, the communication IC's which have been the drawback of the radio frequency type are made common and therefore, a low cost can be realized and moreover, the transmitting and receiving circuits are partly made common and therefore, space saving and a low cost are realized. A plurality of nonvolatile memory communications are effected by a communication IC, whereby if the number of interchangeable units is four, a quarter communication IC cost can be realized, and the simplification and reduced cost of surrounding circuits such as amplification circuits can be realized.

Further, in the present invention, by having an amplitude adjusting circuit for each channel, for a plurality of transmission outputs, it is possible to adjust each of them to a necessary sufficient output. By this system, there is achieved the effect that an image forming apparatus effective for the observation of the regulation by the Wireless Telegraphy Act and the suppression of the unnecessary radiation waves can be designed.

According to the present embodiment, there is achieved the effect that there is provided a system which enables a nonvolatile memory to be carried on each of a plurality of interchangeable units to thereby improve the usability of the system and moreover, is low in cost and high in reliability.

These and other objects and advantages of the invention may be readily ascertained by referring to the following description and accompanying drawings.

DETAILED DESCRIPTION OF THE PREFERRED EMBODIMENTS

Some embodiments of the present invention will hereinafter be described in detail with reference to the drawings. The printing operation, etc. of the image forming apparatus are similar to those of the above-described example of the prior art and therefore need not be described in detail.

(First Embodiment)

Figure 2A:
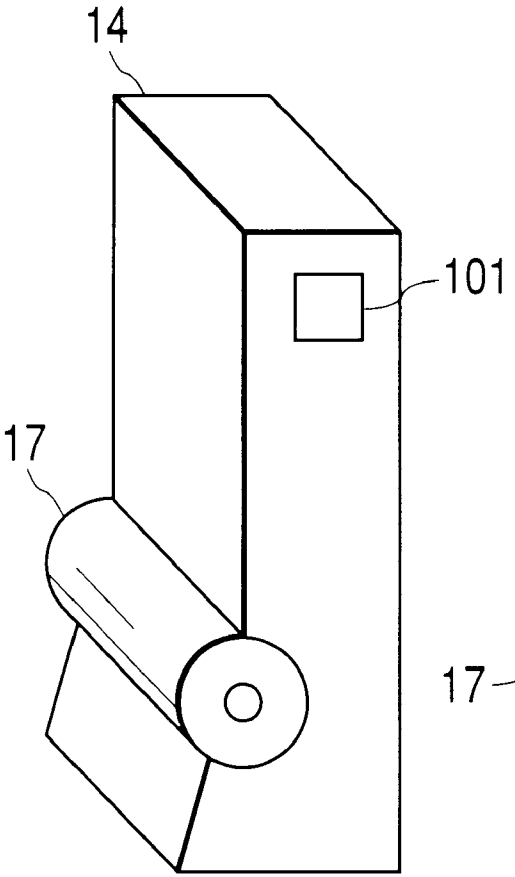
FIG. 2A is a perspective view showing the construction of the developing device of the image forming apparatus according to the first embodiment of the present invention.
Figure 2B:
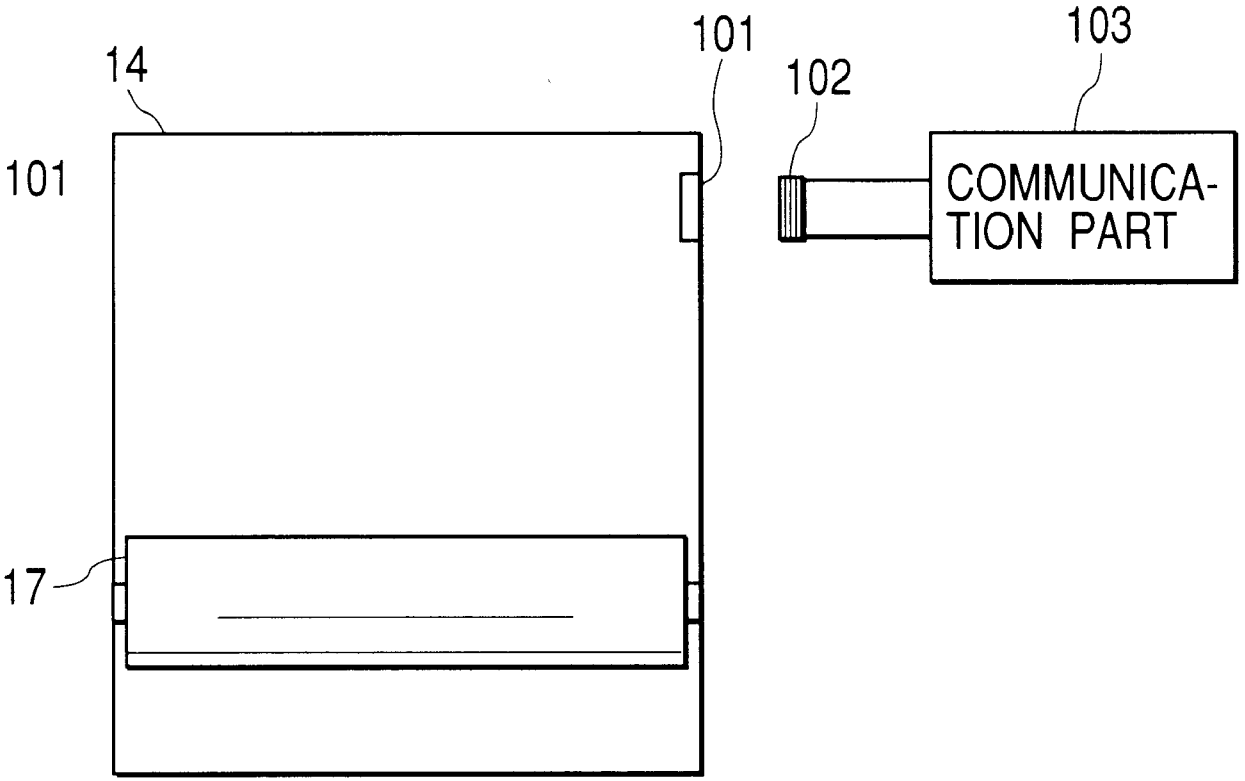
FIG. 2B is a side view showing the construction of the developing device of the image forming apparatus according to the first embodiment of the present invention.

FIGS. 2A and 2B show the construction of the developing device of an image forming apparatus according to a first embodiment of the present invention, FIG. 2A being a perspective view, and FIG. 2B being a side view. The developing device 14 of the image forming apparatus according to the first embodiment of the present invention is similar to the developing device described in connection with the prior art, and constitutes a unit together with a developing roller 17. This developing device 14 is an interchangeable unit, and is a unit to be interchanged when a toner therein is consumed. A memory unit 101 is attached to a surface of this developing device 14 in the upper portion on this side thereof as viewed in FIG. 2A. The main body of the image forming apparatus comprising a communication part 103, and an antenna part 102 is disposed at a location facing to the memory unit 101. By this antenna part 102, the main body of the image forming apparatus can obtain the information of the developing device 14, for example, information such as the consumed amount or remaining amount of the toner.

Figure 1:
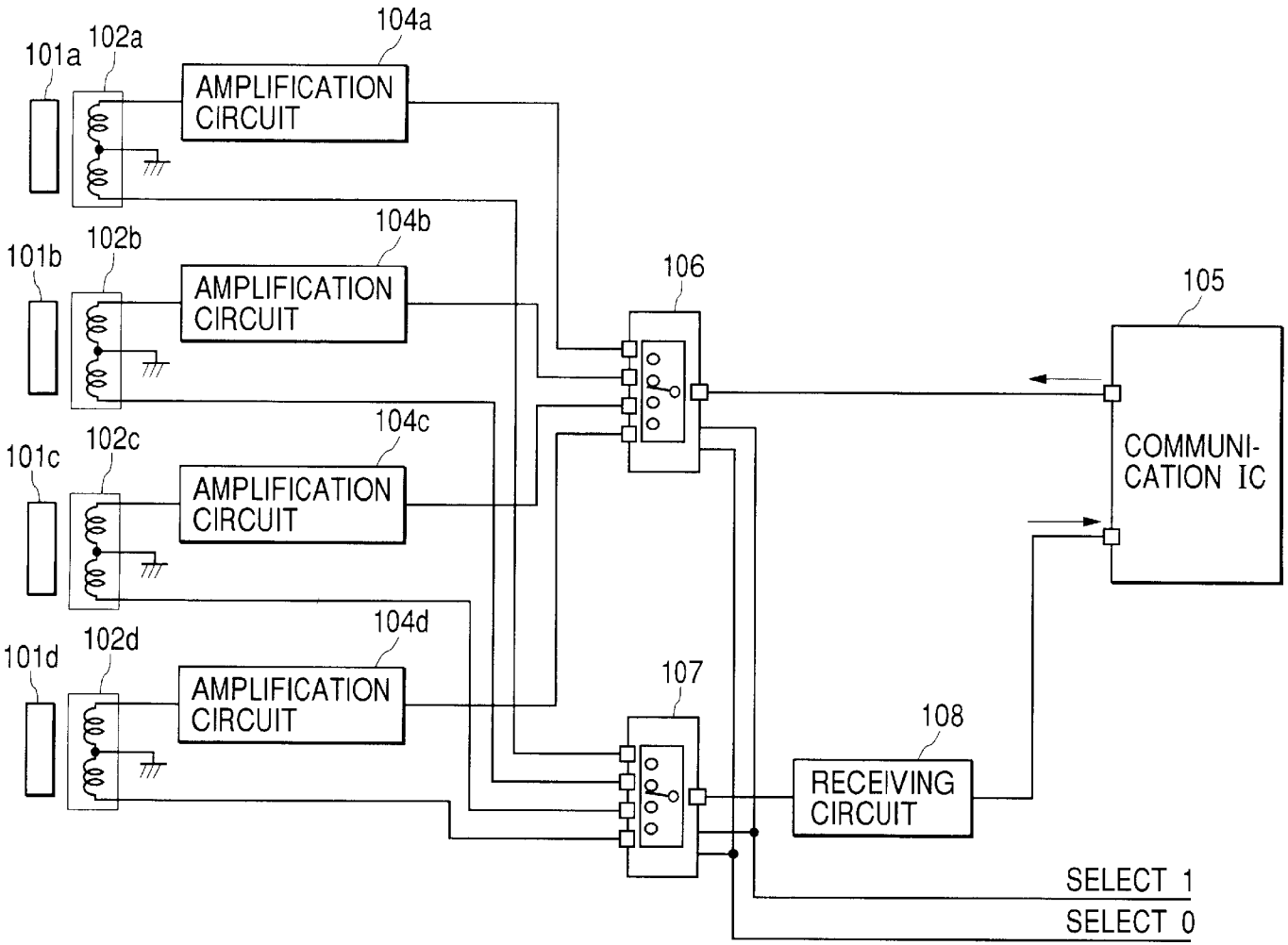
FIG. 1 is a block diagram showing the construction of the communication part of an image forming apparatus according to a first embodiment of the present invention.

FIG. 1 is a block diagram showing the detailed construction of the communication part of the image forming apparatus according to the first embodiment of the present invention. The communication part (communication means) of the image forming apparatus according to the first embodiment of the present invention is provided with antenna parts 102*a*, 102*b*, 102*c*, 102*d* (transmitting and receiving means), amplification circuits 104*a*, 104*b*, 104*c*, 104*d* (amplifying means), a communication IC 105

(communication means), an analog switch 106 (changeover means), an analog switch 107 (second changeover means) and a receiving circuit 108. In FIG. 1, the reference characters 101*a,* 101*b,* 110*c* and 110*d* designate memory units (nonvolatile memories) attached to the developing devices 14.

The memory units 110*a,* 101*b,* 101*c* and 110*d* are units containing therein the nonvolatile memories attached to the developing device 14 which is an interchangeable unit. The antenna parts 102*a,* 102*b,* 102*c* and 102*d* effect transmission and reception, and are comprised of inductors. The amplification circuits 104*a,* 104*b,* 104*c* and 104*d* are circuits performing the amplifying operation in a transmitting circuit. The analog switch 106 is a switch for changing over the transmission signal of the communication IC. The analog switch 107 is a switch for changing over the reception signals of the antenna parts 102*a,* 102*b,* 102*c* and 102*d.* The receiving circuit 108 is a circuit performing the receiving operation.

The communication IC 105 has the function of effecting communication with the memory units 101 on the basis of information designated from a CPU or a logic IC, not shown. The communication IC 105 superimposes the address and data of the memory unit designated by the CPU or the logic IC upon a carrier for supplying electric power to the memory unit 101, and produces a transmission signal. The transmission signal is connected to the transmitting circuit by the analog switch 106.

The analog switch 106 is comprised of an FET, and uses a multiplexer type universal IC containing the decoder function therein. This analog switch 106 is not restricted to the multiplexer type, but can also be comprised of an ordinary analog switch. Also, the decoder can be constructed externally to thereby realize a similar function. Also, in the first embodiment, a dual type universal analog switch having a multiplexer of two circuits contained in a package is used to thereby realize transmission and reception by a single IC. The transmission signal changed over by the analog switch 106 is amplified to a transmission signal having an amplitude width of about 30V by the amplification circuits 104.

The amplification circuit 104 of the present image forming apparatus will be described here with reference to FIG. 3. The amplification circuit 104 is provided with capacitors 30, 31, 32, resistors 33, 34, 35, 36, a variable resistor 37, an inductor 38 and a transistor 39. The capacitor 30 and the resistors 34, 35, 33 are connected to the base of the transistor 39, and the capacitor 32 and a coil 38 are connected to the collector of the transistor 39, and the resistor 36, the capacitor 31 and the variable resistor 37 are connected to the emitter of the transistor 39.

An input signal is coupled by the capacitor 30, and is connected to the base of the transistor 39 given a bias. This transistor 39 should desirably be one for high frequency amplification having a good frequency characteristic. The transistor 39 drives the inductor 38 connected to the collector thereof by the input signal, and amplifies the signal to a great amplitude. The thus amplified signal has its DC component cut through the coupling capacitor 32 of the output stage, and is outputted as an amplitude signal of an AC component.

In the first embodiment, the emitter resistance of a transmitting part can be changed to thereby vary the transmission amplitude. That is, it is possible to adjust the output. The transmitting circuit can be thus adjusted and therefore, it is possible to uniformize the irregularity of the output due to the irregularity of the parts of the transmitting circuit by adjustment. Accordingly, even if there is the irregularity of the parts, it can be easily realized to observe the regulation by the Wireless Telegraphy Act, and it is possible to provide an output which does not emit the unnecessary radiation waves more than necessary.

Turning back to FIG. 1, the amplified transmission signal drives the antenna part 102 comprised of an inductor, and an electromagnetic wave is generated, whereby electric power is supplied to the memory unit 101 and superimposed data is transmitted. The memory unit 101 returns the reception signal on the basis of the transmitted data. The reception signal is received by the antenna part 102, and is received by the receiving circuit through the analog switch 107.

Figure 4:
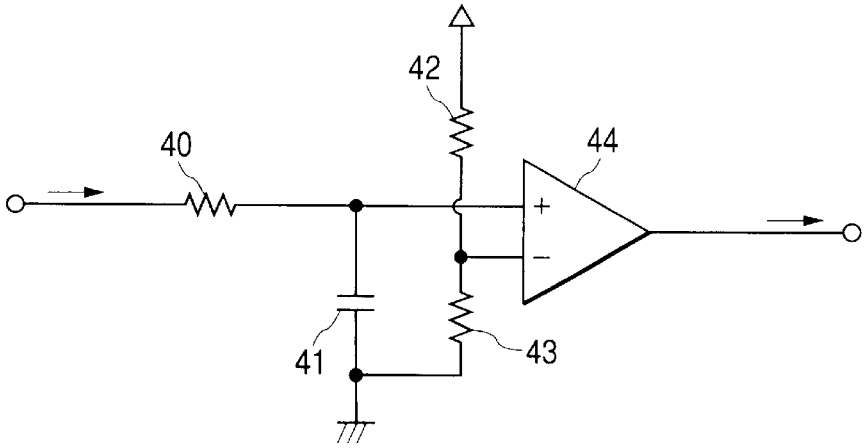
FIG. 4 is a block diagram showing the construction of the receiving circuit of the communication part of the image forming apparatus according to the first embodiment of the present invention.

An example of the receiving circuit 108 of the present image forming apparatus is shown in FIG. 4. The receiving circuit 108 is provided with resistors 40, 42, 43, a capacitor 41 and a comparator 44. The reception signal has its level compared and detected by the comparator 44. The reception signal has its received data taken out by the communication IC 105, and can be read out by the CPU or the logic IC, not shown. By such a system, there is realized a system which can read and write in non-contact with the volatile memories of the interchangeable units.

As described above, the image forming apparatus according to the first embodiment of the present invention is of a construction in which the transmission signal of the communication IC 105 is changed over to a plurality of transmitting circuits of which the outputs can be individually adjusted, by the analog switch 106 low in rated voltage provided at the front stage of the amplification circuits 104*a* to 104*d,* the reception signal of the antenna parts 102*a* to 102*d* is changed over by the analog switch 107, and the receiving circuit 108 is provided at the rear stage of the analog switch 107 and is made common by a circuit and therefore, achieves the following action and effects.

The nonvolatile memories can be mounted in the plurality of interchangeable units detachably mountable on the image forming apparatus to thereby realize a radio frequency memory system unrelated to the reliability of contact of the connector at a low cost. Specifically, a communication IC 105 is used and the analog switch 106 is used to change over the output signal of the communication IC 105 to a plurality of transmitting circuits. The analog switch 106 is very inexpensive as compared with the communication IC 105 and therefore, a plurality of communication IC's 105 are not required and thus, a low cost can be realized. By changing over the output signal by the analog switch 106 to thereby partly make the transmitting and receiving circuits common, whereby it becomes possible to realize space saving and a low cost.

Further, by constructing the amplification circuits 104*a* to 104*d* portion which determines the transmission output of the communication circuit at the rear stage of the analog switch 106, it is possible to adjust a plurality of outputs to necessary sufficient outputs. This is a method effective for the observation of the regulation by the Wireless Telegraphy Act and the suppression of the unnecessary radiation waves which have been described above.

Also, the reception signal is formed by a passive circuit and the output adjustment thereof is unnecessary and therefore, it is formed by a receiving circuit 108. The plurality of antenna parts 102*a* to 102*d* for transmission and reception provided at the front stage of the receiving circuit 108 are designed to be changed over by the analog switch 107, whereby it becomes possible to receive the reception information from the plurality of memory units 110*a* to 110*d* by a receiving circuit 108.

That is, it becomes possible to improve the usability of the apparatus and provide a low cost and high reliability system by mounting nonvolatile memories in a plurality of interchangeable units detachably mountable on the image forming apparatus.

(Second Embodiment)

Figure 5:
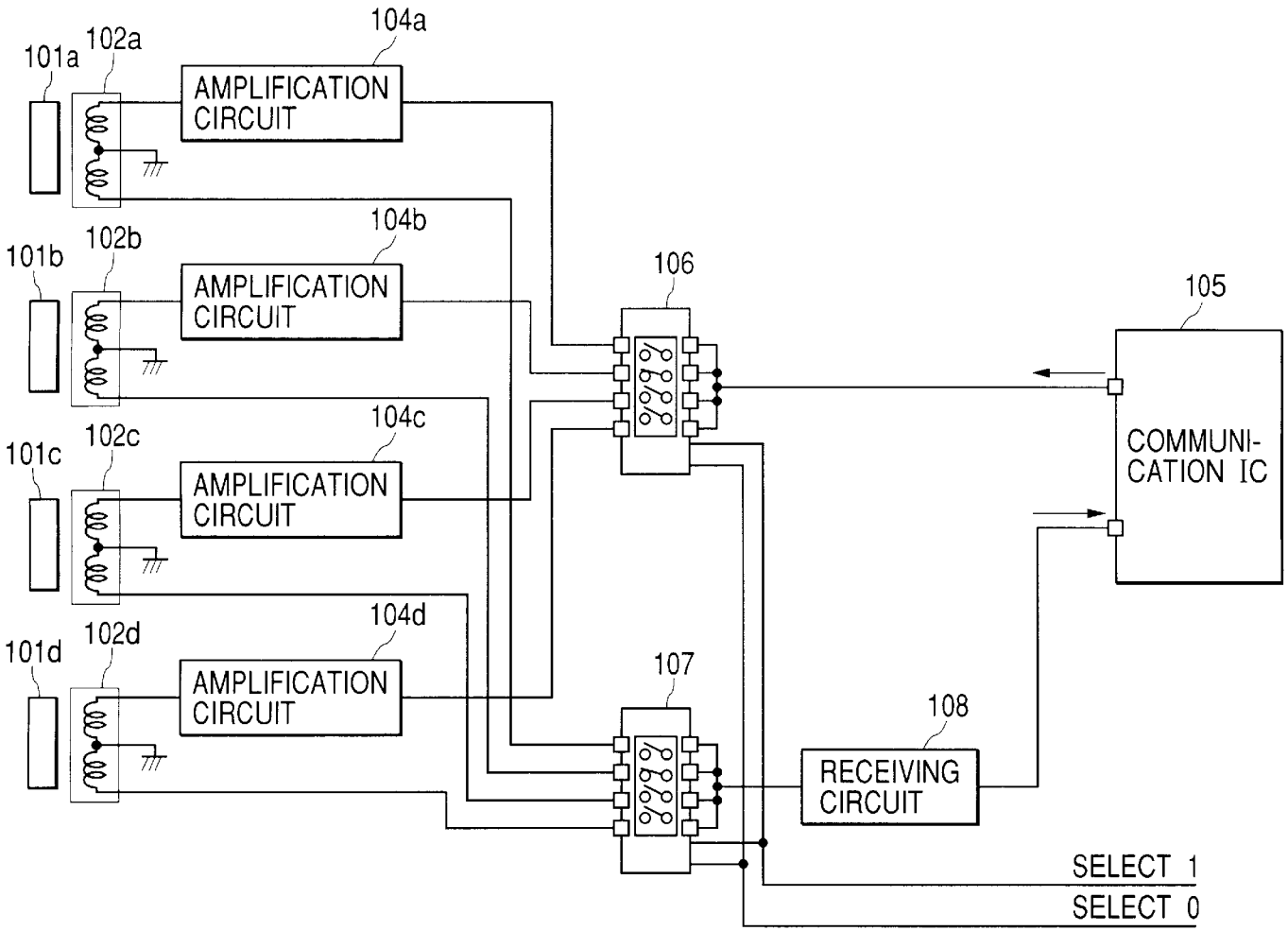
FIG. 5 is a block diagram showing the construction of the communication part of an image forming apparatus according to a second embodiment of the present invention.

FIG. 5 is a block diagram showing the detailed construction of the communication part of an image forming apparatus according to a second embodiment of the present invention. The communication part of the image forming apparatus according to the second embodiment of the present invention is provided with antenna parts 102*a,* 102*b,* 102*c,* 102*d,* amplification circuits 104*a,* 104*b,* 104*c,* 104*d,* a communication IC 105, an analog switch 106, an analog switch 107 and a receiving circuit 108. In FIG. 5, the reference characters 110*a,* 101*b,* 101*c* and 110*d* denote memory units attached to the developing devices 14.

The memory units 110*a,* 101*b,* 101*c* and 101*d* are units containing therein nonvolatile memories attached to the developing devices 14 which are interchangeable units. The antenna parts 102*a,* 102*b,* 102*c* and 102*d* effect transmission and reception, and are comprised of inductors. The amplification circuits 104*a,* 104*b,* 104*c* and 104*d* are circuits performing the amplifying operation in a transmitting circuit. The analog switch 106 is a switch for changing over the transmission signal of the communication IC. The analog switch 107 is a switch for changing over the reception signals of the antenna parts 102*a,* 102*b,* 102*c* and 102*d*. The receiving circuit 108 is a circuit performing the receiving operation.

The communication IC 105 has the function of effecting communication with the memory unit 101 on the basis of information designated from a CPU or a logic IC, not shown. The communication IC 105 superimposes the address and data of the memory unit designated by the CPU or the logic IC upon a carrier for supplying electric power to the memory unit 101, and produces a transmission signal. The transmission signal is connected to the transmitting circuit by the analog switch 106. The analog switch 106 is an analog switch comprised of an FET and containing the decoder function therein. The analog switch in the second embodiment, unlike the multiplexer type analog switch in the above-described first embodiment, has its input sides made common externally of the analog switch to thereby realize signal changeover. The receiving side analog switch 107 is of a similar construction and can realize signal changeover.

In the other points, the construction of the communication in the second embodiment is the same as what has been described in the first embodiment. By such a system, there is realized a system which can read and write in non-contact with the nonvolatile memories of the interchangeable units.

As described above, according to the image forming apparatus according to the second embodiment of the present invention, as in the above-described first embodiment, it becomes possible to improve the usability of the apparatus and provide a low cost and high reliability system by mounting nonvolatile memories in a plurality of interchangeable units detachably mountable on the image forming apparatus.

(Third Embodiment)

Figure 6:
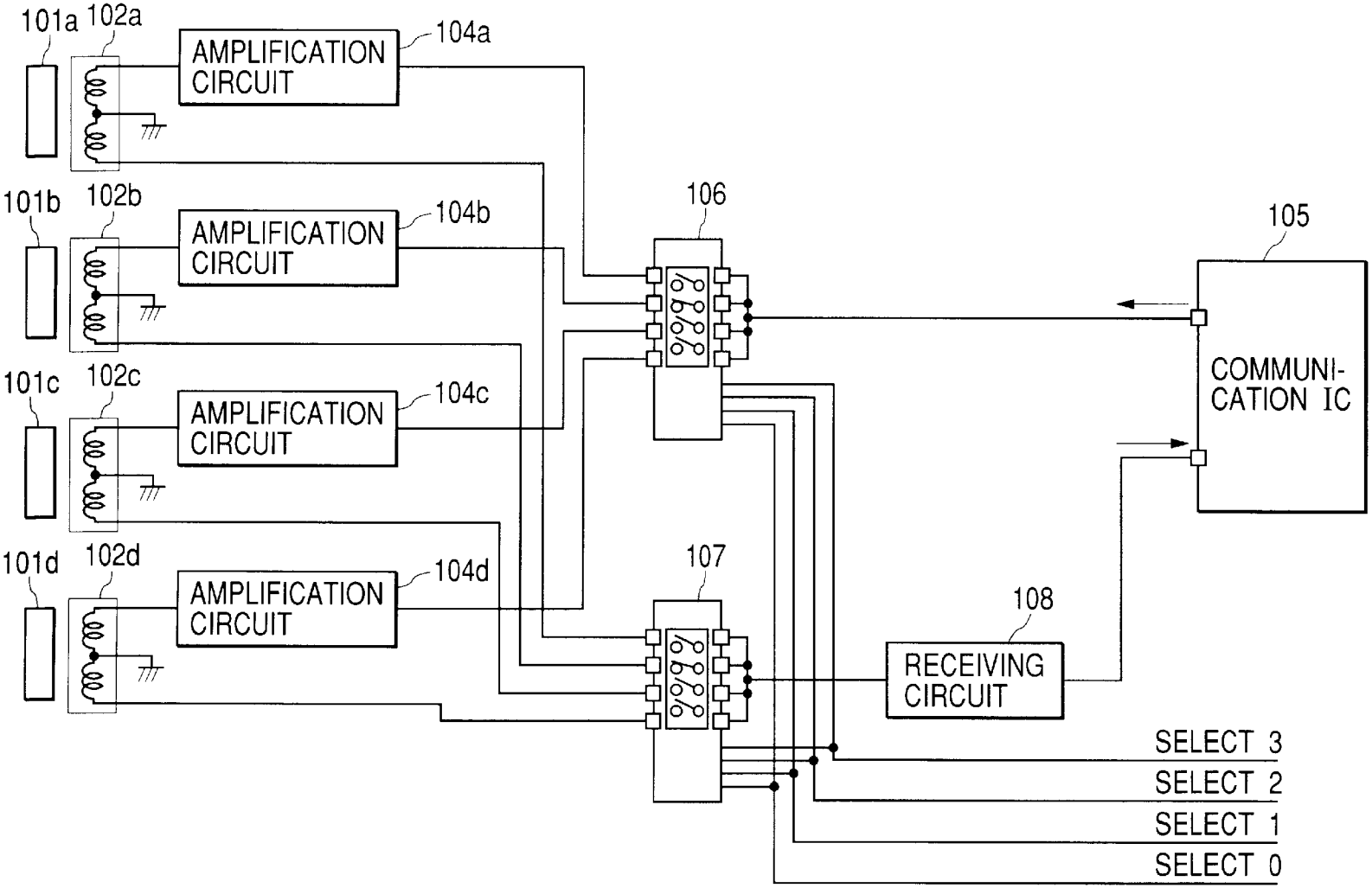
FIG. 6 is a block diagram showing the construction of the communication part of an image forming apparatus according to a third embodiment of the present invention.

FIG. 6 is a block diagram showing the detailed construction of the communication part of an image forming apparatus according to a third embodiment of the present invention. The communication part of the image forming apparatus according to the third embodiment of the present invention is provided with antenna parts 102*a,* 102*b,* 102*c,* 102*d,* amplification circuits 104*a,* 104*b,* 104*c,* 104*d,* a communication IC 105, an analog switch 106, an analog switch 107 and a receiving circuit 108. In FIG. 6, the reference characters 110*a,* 101*b,* 101*c* and 110*d* designate memory units attached to the developing devices 14.

The memory units 110*a,* 101*b,* 101*c* and 110*d* are units containing therein the nonvolatile memories attached to the developing devices 14 which are interchangeable units. The antenna parts 102*a,* 102*b,* 102*c* and 102*d* effect transmission and reception, and are comprised of inductors. The amplification circuits 104*a,* 104*b,* 104*c* and 104*d* are circuits performing the amplifying operation in a transmitting circuit. The analog switch 106 is a switch for changing over the transmission signal of the communication IC. The analog switch 107 is a switch for changing over the reception signals of the antenna parts 102*a,* 102*b,* 102*c* and 102*d*. The receiving circuit 108 is a circuit performing the receiving operation.

The communication IC 105 has the function of effecting communication with the memory unit 101 on the. basis of information designated from a CPU or a logic IC, not shown. The communication IC 105 superimposes the address and data of the memory unit designated by the CPU or the logic IC upon a carrier for supplying electric power to the memory unit 101, and produces a transmission signal. The transmission signal is connected to the transmitting circuit by the analog switch 106. The analog switch 106 is comprised of an FET. An analog switch having no decoder function is more inexpensive than the decoder function containing type one.

So, in the third embodiment, there is adopted a construction in which four select signals are wired from a control board, not shown, and are directly selected from the CPU or the logic IC or the like. The analog switch 106, as in the above-described second embodiment, has its input sides made common externally of the analog switch to thereby realize the changeover of the transmission signal by the above-mentioned select signals. The analog switch 107 on the receiving side can also realize signal changeover by a similar construction.

In the other points, the construction of the communication in the third embodiment is the same as what has been described in the first embodiment and the second embodiment. By such a system, a system which can read and write in non-contact with the nonvolatile memories of the interchangeable units can be realized by a more inexpensive construction.

As described above, according to the image forming apparatus according to the third embodiment of the present invention, it becomes possible to improve the usability of the apparatus and provide a low cost and high reliability system by mounting nonvolatile memories in a plurality of interchangeable units detachably mountable on the image forming apparatus.

(Fourth Embodiment)

Figure 7:
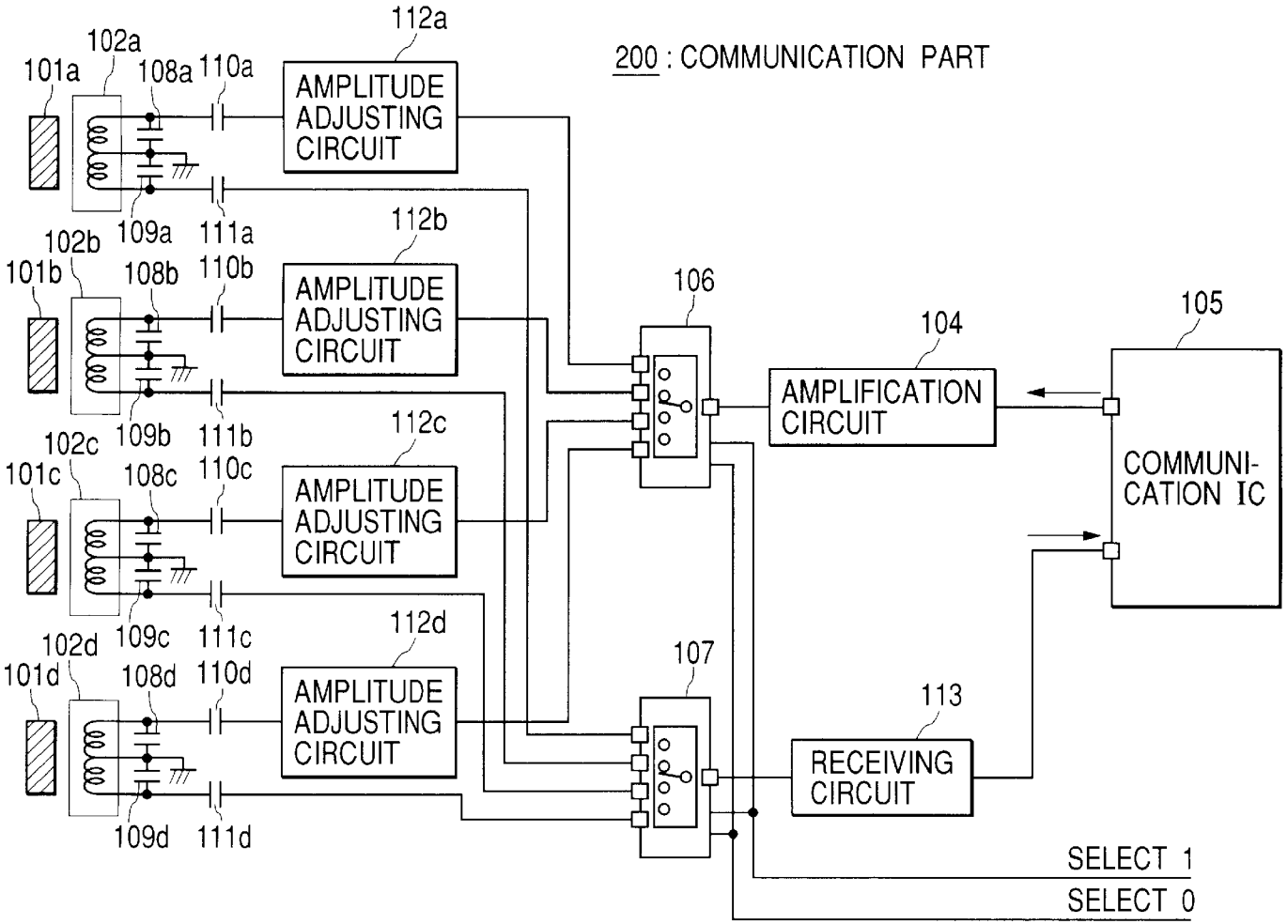
FIG. 7 shows a communication part 200 in an image forming apparatus which is a fourth embodiment of the present invention.

FIG. 7 shows a communication part 200 in an image forming apparatus which is a fourth embodiment of the present invention.

The communication part 200 is comprised of a communication IC 105, memory units 110*a,* 101*b,* 101*c,* 110*d* containing therein nonvolatile memories attached to the developing devices 14 which are interchangeable units, and an inductor, and is provided with antenna parts 102*a,* 102*b,* 102*c,* 102*d* for effecting transmission and reception, an amplification circuit 104 capable of adjusting the gain in a transmitting circuit, amplitude adjusting circuits 112*a,* 112*b,* 112*c,* 112*d* in the transmitting circuit, an analog switch 106 for changing over a transmission signal, an analog switch 107 for changing over a reception signal, and a receiving circuit 113.

The communication IC 105 effects communication with the memory unit 101 on the basis of information designated from a CPU or a logic IC, not shown, superimposes the address, command and data of the memory unit designated by the CPU or the logic IC upon a carrier for supplying electric power to the memory unit 101, and produces the transmission signal.

The transmission signal is amplified to a transmission signal having an amplitude width of several tens of volts by the amplification circuit 104, and thereafter is changed over to each channel by the analog switch 106. The analog switch 106 is comprised of an FET, and uses a multiplexer type universal IC containing the decoder function therein.

SELECT0 and SELECT1 signals are signals for selecting one of the four memory units, and are designated by the CPU or the logic IC, not shown, and the analog switch corresponding to the memory unit to be selected is closed by a decoder contained in the analog switch.

The above-described analog switch can also be comprised of other ordinary analog switch than the multiplexer type one, and may be a switch using a diode bridge, a switch using a discrete FET, or an analog switch comprising a combination of an N type FET and a P type FET, or further may be a mechanical relay or the like. Also, the decoder can also be constructed externally to thereby realize a similar function.

The signal passed through the switch 106 has its amplitude limited by the amplitude adjusting circuit 112.

Figure 3:
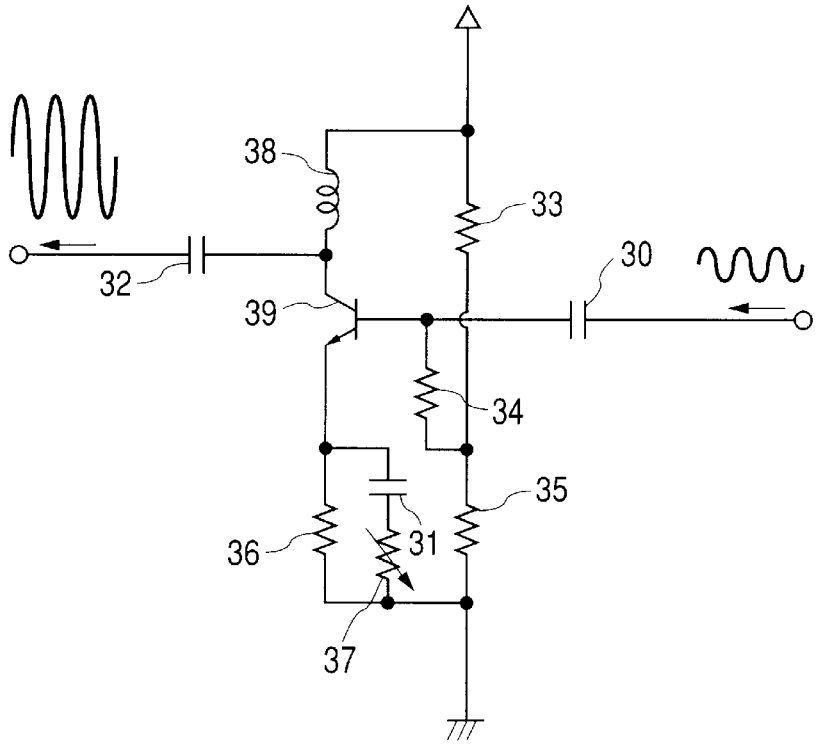
FIG. 3 is a circuit diagram showing the construction of the amplification circuit of the communication part of the image forming apparatus according to the first embodiment of the present invention.

The amplification circuit 104 in the communication part 200 is similar to that shown in FIG. 3 and need not be described.

Figure 8:
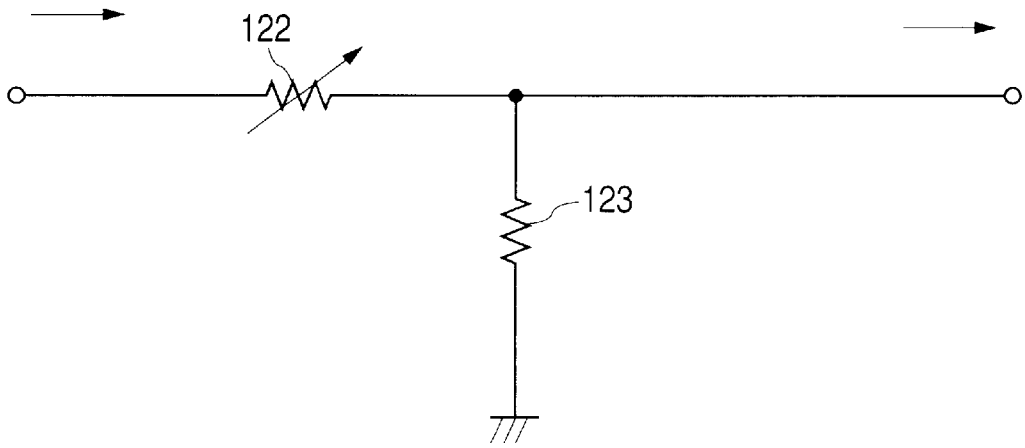
FIG. 8 shows an amplitude adjusting circuit 112*a* in the image forming apparatus which is the fourth embodiment of the present invention.

FIG. 8 shows an amplitude adjusting circuit 112*a* in the image forming apparatus which is the fourth embodiment.

The signal has its amplitude decreased to $\gamma 1/(\gamma 1+\gamma v)$ by the resistance division of a variable resistor 122 (resistance value $\gamma v$) and a fixed resistor 123 (resistance value $\gamma 1$), and this signal decreased in amplitude is sent to the next stage. Usually, the variable resistor 122 is 0 ohm, and the input signal is intactly passed. When the signal amplitude at the antenna is too great and the electric wave is too strong for the Wireless Telegraphy Act and the operating condition of the radio frequency memories, $\gamma v$ is increased so as to decrease the amplitude. The amplitude adjusting circuit 112 is provided for each channel so that the adjustment of all channels may be possible.

The construction of amplitude adjusting circuits 112*b*, 112*c* and 112*d* is similar to the construction of the amplitude adjusting circuit 112*a*.

The transmission signal having had its amplitude adjusted drives the antenna part 102 comprised of an inductor through a coupling capacitor 110 and generates an electromagnetic wave to thereby supply electric power to the memory unit 101 and also transmit the superimposed data.

The inductors of the antenna parts and tuning capacitors 108*a*, 108*b*, 108*c*, 108*d* together constitute a resonance circuit for making the carrier of the signal into a desonance frequency. The memory units return the reception signal on the basis of the transmission data. The reception signal is received by the antenna part 102, and is received by the receiving circuit through the analog switch 107. Like the inductor of the transmitting part, the inductor of the receiving part, together with tuning capacitors 109*a*, 109*b*, 109*c*, 109*d*, constitute a resonance circuit.

Figure 9:
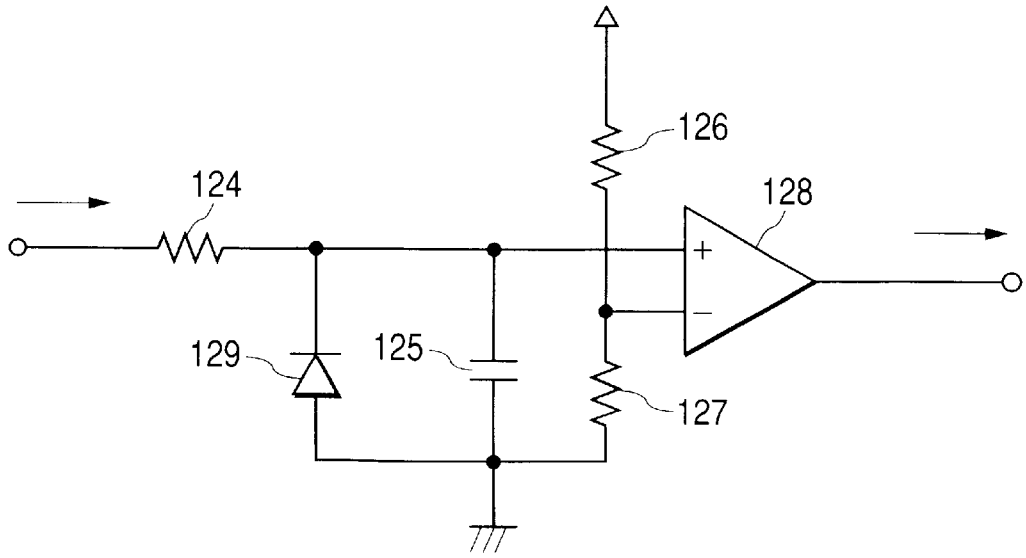
FIG. 9 shows a receiving circuit 113 in the image forming apparatus which is the fourth embodiment of the present invention.

FIG. 9 shows the receiving circuit 113 in the image forming apparatus which is the fourth embodiment.

The reception signal is rectified by a half-wave rectification circuit constituted by a resistor 124, a diode 129 and a capacitor 125, and the level thereof is compared and detected by a comparator 128. The reference voltage with which the level is compared is obtained by resistance-dividing a power source voltage by resistors 126 and 127. The communication IC 105 takes out the reception data from the reception signal, and the reception data is read out by the CPU or the logic IC, not shown. By such a system, there is constituted a system which can read and write in non-contact with the nonvolatile memories of the interchangeable units.

Description will now be made of the algorism during adjustment in the fourth embodiment.

The electric power of all antennas or a parameter indirectly indicative of the electric power like the voltage amplitude in the antennas is first measured. Among a plurality of channels, there exists the irregularity of the output electric power due to the manufacturing irregularity of elements constituting the circuit and the pattern irregularity of a substrate. A variable resistor 118 at the amplifying stage is varied to thereby adjust the gain so that the output of the channel which is weakest in output may have a predetermined margin relative to the lower limit at which the communication with the radio frequency memories is possible.

Next, when there exists a channel in which the output of a channel of which the electric power is great exceeds the regulation value of the Wireless Telegraphy Act or the operating condition of the radio frequency memories, the variable resistor 122 of the amplitude adjusting circuit 112 is varied to thereby attenuate the output so as to be kept within the regulation value. This adjustment is carried out to all the channels of which the outputs exceed the regulation value. If there is no channel of which the output exceeds the regulation value, the adjustment by the amplitude adjusting circuit is not required.

As described above, there can be realized an image forming apparatus provided with a radio frequency memory system in which an amplifying stage is provided for a communication IC, and switches 106, 107 and amplitude adjusting circuits 112*a*, 112*b*, 112*c*, 112*d* are provided, whereby the communication of a plurality of interchangeable units with radio frequency memories becomes possible, and which is low in cost and high in reliability because of the curtailment of the cost of a substrate by a reduction in the cost of parts and the area of the substrate. Also, even if there exists the irregularity of the output electric power due to the manufacturing irregularity of elements constituting the circuit and the pattern irregularity of the substrate, amplitude adjusting circuits 112*a* to 112*d* (output adjusting circuits) are provided in respective channels, whereby the signal amplitude of channels of electric power greater than the standard can be adjusted and be kept within the standard.

While each of the above-described embodiments uses radio frequency memories attached to four yellow, magenta, cyan and black toner containers, the radio frequency memories may be ones attached to other interchangeable parts than the toner containers. Also, the number of the radio frequency memories may be set to other number than 4.

Further, in the above-described fourth embodiment, the number of each of the communication IC and the amplification circuit is one, but if communication is effected with a plurality of memory units by a communication IC, the cost can be reduced, and for example, when communication is to be effected with a group of memory units greatly differing in position from one another, a plurality of communication IC's may be provided so as to effect communication with a plurality of nearby memory units.

As described above, in the communication part 200 which is the fourth embodiment, an image forming apparatus of the tandem type in which radio frequency memories are carried on a plurality of interchangeable units and which uses a radio frequency memory system unrelated to the reliability of contact of a connector can be realized at a low cost. Specifically, an amplification circuit variable in amplification factor is provided for the output of a communication IC, and provision is made of a switch for changing over an amplified signal to one of a plurality of memory units (a switch for changing over the channels), and a circuit capable of adjusting the amplitude of the amplified signal, and after the gain of the amplifying stage is adjusted so that the electric power of the channel smallest in output of the channels having output irregularity among them can communicate with the radio frequency memories, if there exists a channel putting out such an output as exceeds the standard of the Wireless Telegraphy Act or exceeds the upper limit of a power source voltage made by the radio frequency memories, adjustment is effected by the amplitude adjusting circuit to thereby effect communication with the plurality of radio frequency memories by a memory control IC and an amplification circuit.

The amplification circuit acts to amplify the output of the memory control IC so that the electric power of the channel smallest in output may become electric power sufficient to be capable of communicating with the radio frequency memories. The switch acts to select the output of an amplification circuit from one of a plurality of channels. The amplitude adjusting circuit acts to adjust the signal amplitude of a channel greater in electric power than the standard and keep it within the standard.

(Fifth Embodiment)

Figure 10:
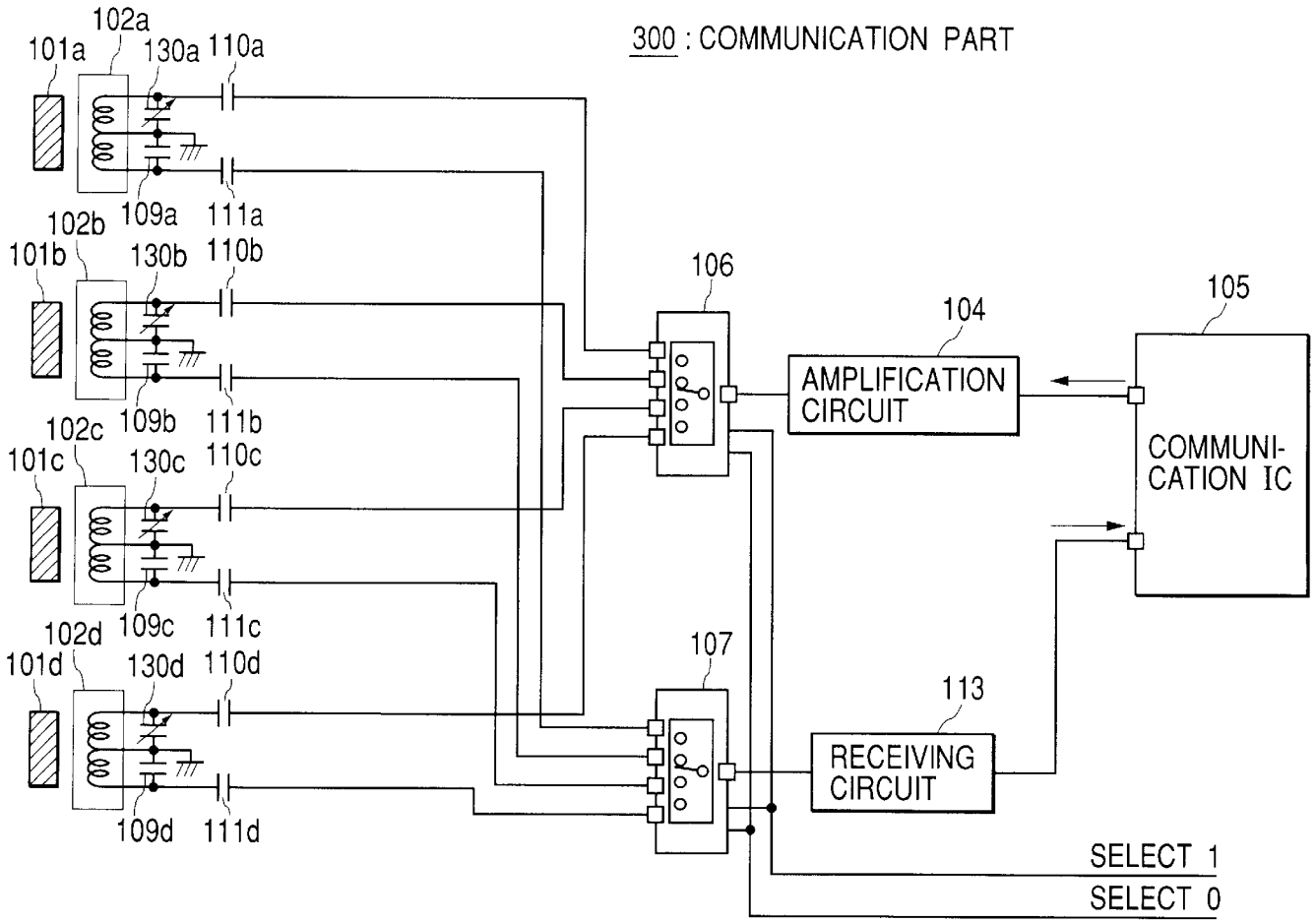
FIG. 10 shows the circuit construction of a communication part 300 in an image forming apparatus which is a fifth embodiment of the present invention.

FIG. 10 shows the circuit construction of a communication part 300 in an image forming apparatus which is a fifth embodiment of the present invention.

The image forming apparatus which is the fifth embodiment is similar in shape and construction to the image forming apparatus according to the fourth embodiment.

In the fourth embodiment, at least two resistors are provided for each memory unit, and this leads to some fear for an increase in cost. In this point, in the fifth embodiment, the tuning capacitors of the antenna parts are variable capacity capacitors, whereby the adjustment of amplitude is effected.

The fifth embodiment shown in FIG. 10 is an embodiment in which, in the fourth embodiment shown in FIG. 7, the amplitude adjusting circuits 112*a* to 112*d* by resistance division are eliminated and variable capacitors 130*a* to 130*d* are provided instead of the capacitor 108.

When the value of the inductor of the antenna is defined as I1 and the capacity of the tuning capacitor is defined as c1, the tuning circuit resonates at a frequency of $\frac{1}{2}\pi\sqrt{(I1 \cdot c1)}$. Usually, the resonance frequency is adjusted to the frequency of the carrier.

In the fourth embodiment, the capacity of the turning capacitor of a channel of which the amplitude is to be suppressed is varied and the resonance frequency is slightly shifted to thereby drop the gain of the tuning circuit at the frequency of the carrier, and effect amplitude adjustment.

Description will now be made of the algorism for adjusting in the fifth embodiment.

The electric power of all antennas or a parameter indirectly indicative of the electric power like the voltage amplitude in the antennas is first measured. Among a plurality of channels, there exists the irregularity of the output electric power due to the manufacturing irregularity of elements constituting the circuit and the pattern irregularity of a substrate. A variable resistor 118 at the amplifying stage is varied to thereby adjust the gain so that the output of the channel which is weakest in output may have a predetermined margin relative to the lower limit at which the communication with the radio frequency memories is possible.

Next, when there exists a channel in which the output of a channel of which the electric power is great exceeds the regulation value of the Wireless Telegraphy Act or the operating condition of the radio frequency memories, the value of the capacitor of the tuning circuit is varied to thereby attenuate the signal and adjust the output so as to be kept within the regulation value. This adjustment is carried out to all the channels of which the output exceed the regulation value. If there is no channel of which the output exceeds the regulation value, the adjustment by the amplitude adjusting circuit is unnecessary.

As described above, there can be realized an image forming apparatus provided with a radio frequency memory system in which an amplifying stage is provided for a communication IC, and switches and variable capacity capacitors are provided, whereby the communication of a plurality of interchangeable units with radio frequency memories becomes possible, and which is low in cost and high in reliability because of the curtailment of the cost of a substrate by a reduction in the cost of parts and the area of the substrate.

Further, even if there exists the irregularity of the output electric power due to the manufacturing irregularity of elements constituting the circuit and the pattern irregularity of the substrate, a variable capacity is provided in each channel and the output is made adjustable, whereby the signal amplitude of channels of electric power greater than the standard can be adjusted and be kept within the standard.

While each of the above-described embodiments has radio frequency memories attached to four yellow, magenta, cyan and black toner containers, the radio frequency memories may be ones attached to other interchangeable parts than the toner containers. Also, the number of the radio frequency memories need not always be four. Further, in the fifth embodiment, the number of each of the communication IC and the amplification circuit is one, but if communication is effected with a plurality of memory units by a communication IC, a cost reduction can be achieved and therefore, for example, when communication is to be effected with a group of memory units greatly differing in position from one another, a plurality of communication IC's may be provided so as to effect communication with a plurality of nearby memory units.

In the communication part 300 which is the fifth embodiment, an amplification circuit variable in amplification factor is provided for a communication IC, and provision is made of a switch for changing over an amplified signal, and an antenna part comprising a variable capacity and an inductor for transmitting the signal to the radio frequency memories. After the gain of the amplifying stage is adjusted so that the electric power of the channel smallest in output of the channels having output irregularity among them can communicate with the radio frequency memories, if there exists a channel putting out such a great output as exceeds the standard of the Wireless Telegraphy Act or exceeds the upper limit of a power source voltage made by the radio frequency memories, the value of the variable capacitor of the tuning circuit of the antenna part is adjusted and the amplitude is attenuated, whereby the regulation is observed and yet the communication of the plurality of radio frequency memories is effected by a memory control IC and an amplification circuit.

The amplification circuit acts to amplify the output of the memory control IC so that the electric power of the channel smallest in output may become electric power sufficient to be capable of communicating with the radio frequency memories. The switch acts to select the output of an amplification circuit from one of a plurality of channels. The variable capacity acts to attenuate the signal amplitude of a channel greater in electric power than the standard and keep it within the standard.

(Sixth Embodiment)

Figure 11:
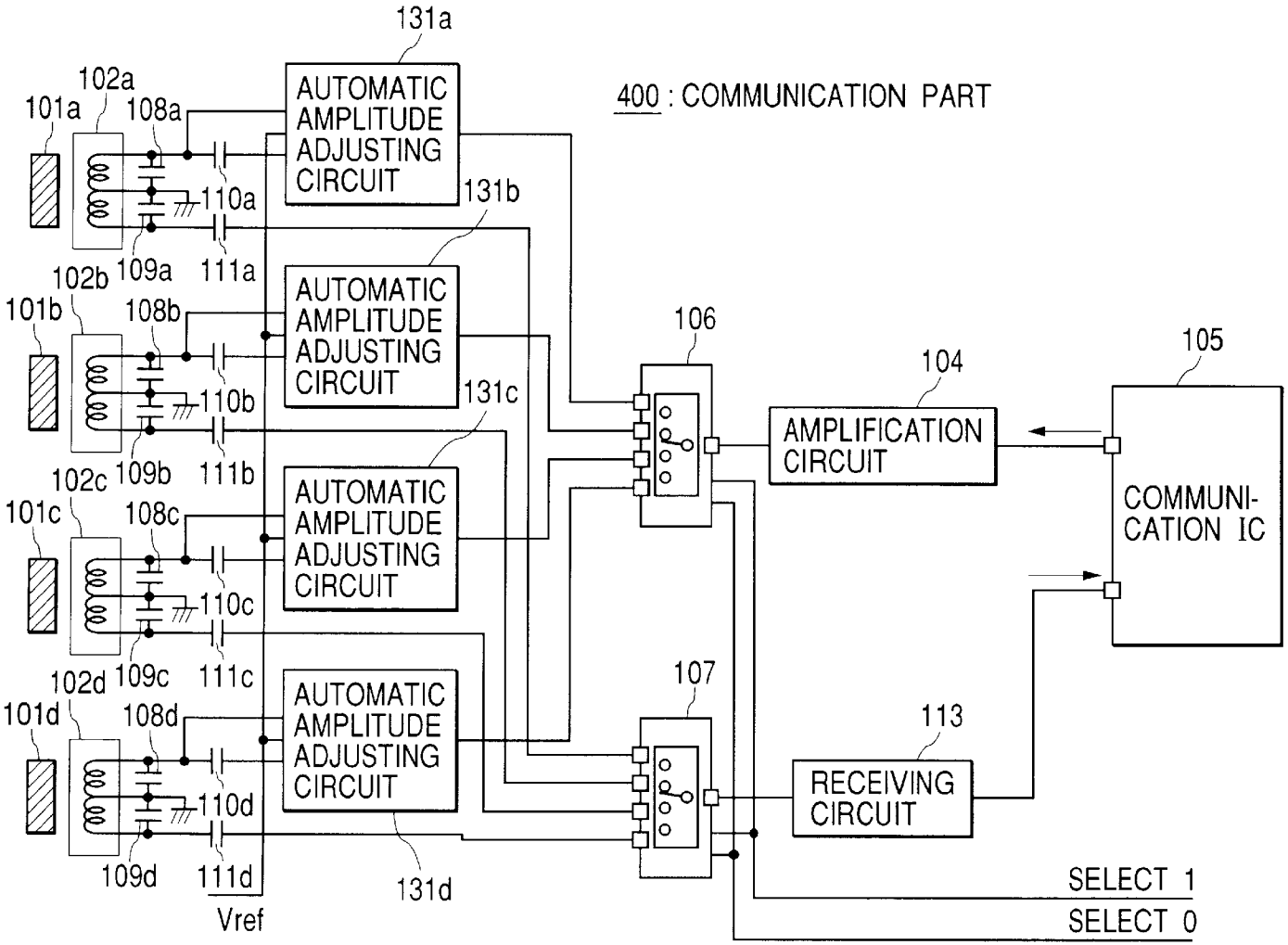
FIG. 11 shows the circuit construction of a communication part 400 in an image forming apparatus which is a sixth embodiment of the present invention.

FIG. 11 shows the circuit construction of a communication part 400 in an image forming apparatus which is a sixth embodiment of the present invention.

The image forming apparatus which is the sixth embodiment is similar in shape and construction to the image forming apparatus according to the fourth embodiment.

The difference of the sixth embodiment from the fourth embodiment shown in FIG. 7 is that an automatic amplitude adjusting circuit 131 is provided between the switch for changing over the channel and the antenna. In the fourth embodiment and the fifth embodiment, it is necessary to measure the amplitude of the voltage of the antenna for each channel, and manually effect the adjustment of the gain of the whole by the resistor 118, the judgment as to whether the individual adjustment by the amplitude adjusting circuit 112 should be effected, and the actual adjustment, and this leads to the problem that an adjusting time and much cost are required.

So, in the sixth embodiment, automatic amplitude adjusting circuits 131*a*, 131*b*, 131*c* and 131*d* are provided so that the output amplitudes of all channels may become substantially constant.

Figure 12:
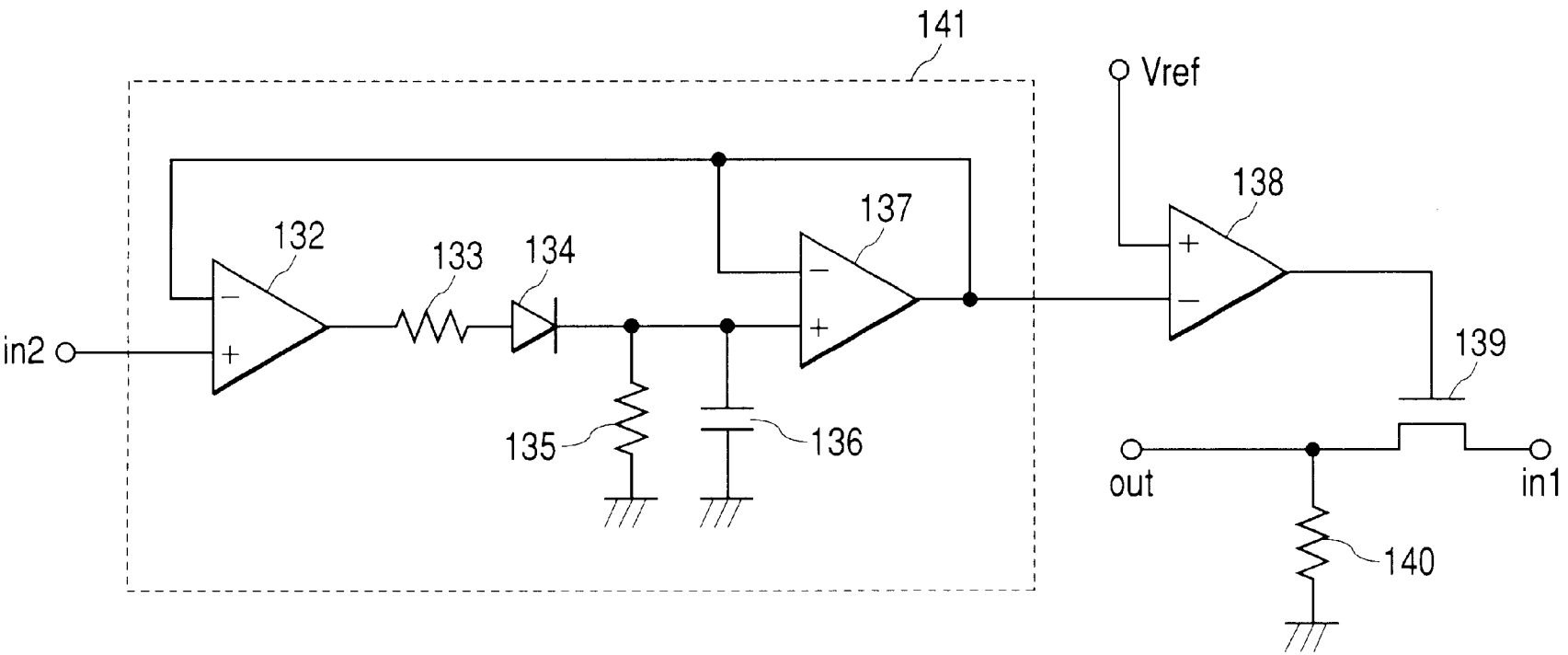
FIG. 12 shows an automatic amplitude adjusting circuit 131*a* in the communication part 400.
Figure 13:
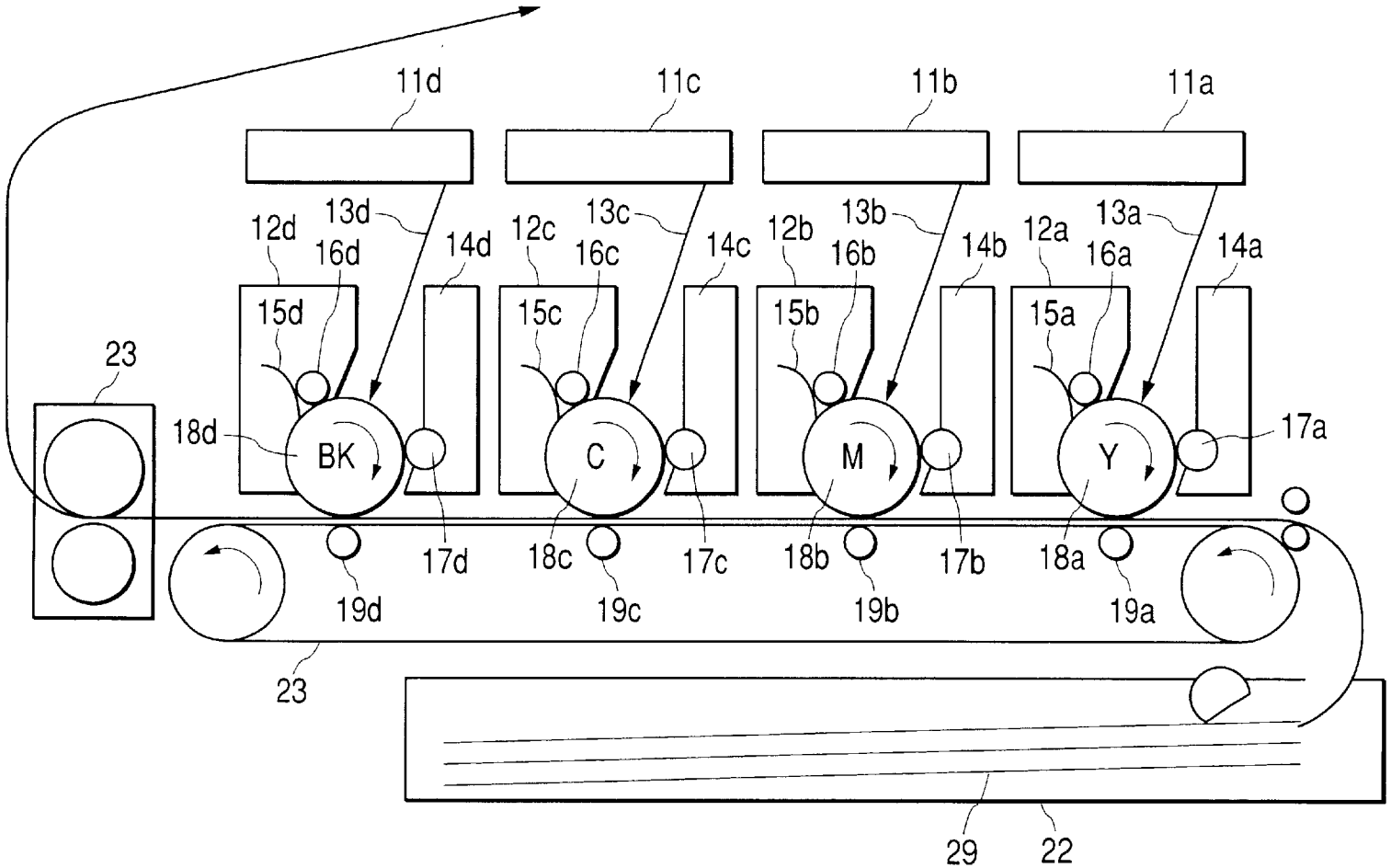
FIG. 13 shows the construction of the image forming portion of an ordinary image forming apparatus.
Figure 14:
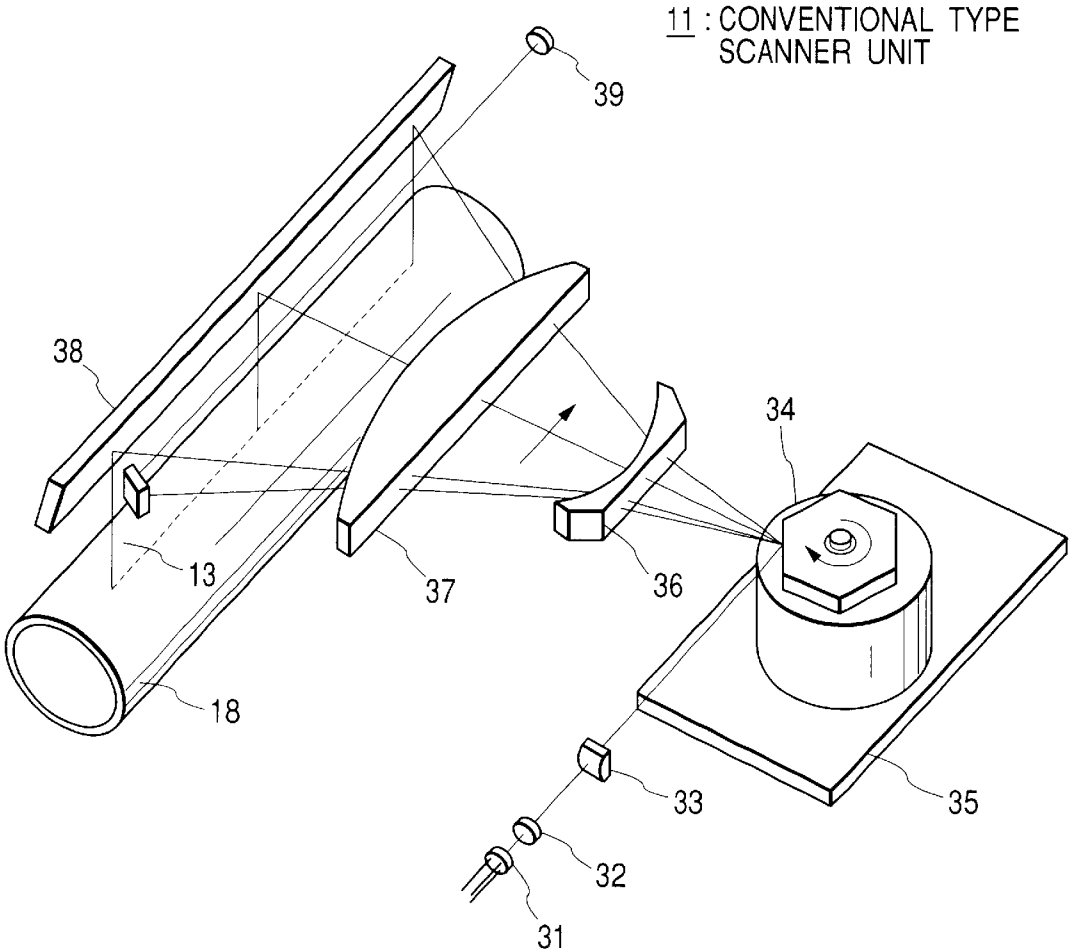
FIG. 14 is a perspective view showing the construction of the scanner unit of the ordinary image forming apparatus.
Figure 15:
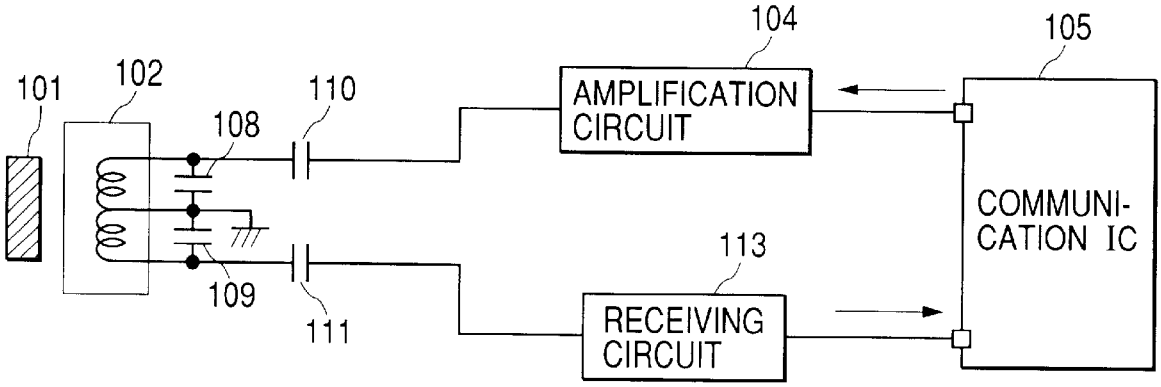
FIG. 15 is a circuit diagram showing the communication part 600 of an image forming apparatus of the conventional type.

FIG. 12 shows the automatic amplitude adjusting circuit 131*a* in the communication part 400.

The construction of the automatic amplitude adjusting circuits 131*b*, 131*c* and 131*d* is similar to the construction of the automatic amplitude adjusting circuit 131*a*.

In1 designates the input of a transmission signal, and out denotes the output thereof. In2 designates an input for monitoring the output voltage of the antenna.

Vref denotes a reference voltage corresponding to the target value of the amplitude, and is sufficiently capable of communicating with the memory units, and moreover is set to a voltage value corresponding to such an amplitude as will not exceed the Wireless Telegraphy Act and the operating condition of the radio frequency memory. The voltage of the antenna is inputted to a peak detection circuit 141, and the peak value thereof is inputted to the reversal terminal of a comparator 138.

When the amplitude of the output voltage of the antenna is too greater than the target value thereof, the output of the peak detection circuit 141 becomes greater than the reference voltage Vref and the output of the comparator lowers. Therefore, the gate voltage of an NMOS 139 decreases and the ON resistance thereof increases. The input signal is voltage-divided by the ON resistance of the NMOS 139 and a resistor 140 and is outputted and therefore, the voltage of the out terminal decreases. Accordingly, negative feedback is applied so that the output voltage of the antenna may decrease.

When conversely, the amplitude of the output voltage of the antenna is too smaller than the target value thereof, the output of the peak detection circuit 141 becomes smaller than the reference voltage Vref, and the output of the comparator increases. Therefore, the gate voltage of the NMOS 139 rises, the ON resistance thereof decreases and the voltage of the out terminal increases. Accordingly, negative feedback is applied so that the output voltage of the antenna may increase.

In the manner described above, the output of the antenna is automatically adjusted so as to assume a target amplitude corresponding to Vref, and the trouble of judging the magnitude of the amplitude for each channel, and manually effecting adjustment as required can be omitted and thus, the adjustment cost can be reduced.

As regards the gain of the amplification circuit, the resistor 118 in the amplification circuit 104 is preselected so that the output of the channel weakest in output may have a sufficient margin relative to the lower limit at which the communication with the radio frequency memories is possible. The adjustment of the amplitude is effected by the automatic amplitude adjusting circuit and therefore, the amplification circuit can output a sufficiently great signal, and the resistance value need not always be made variable.

The operation of the peak detection circuit 141 in the automatic amplitude adjusting circuit 131*a* will be described briefly here.

When the input voltage in2 is smaller than the initial output V0 of an operational amplifier 137, the output of an operational amplifier 132 decreases. The non-reversal input of the operational amplifier 137 is initially V0 and therefore, a diode 134 assumes a reverse bias and the voltage of the non-reverse input of the operational amplifier 137 is kept at V0. Accordingly, the output of the operational amplifier 137 forming a voltage follower does not change while keeping V0.

When conversely, the input voltage in2 is greater than V0, the output of the operational amplifier 132 increases. The non-reversal input of the operational amplifier 137 is initially V0 and therefore, the diode 134 assumes a forward bias and the voltage of the non-reverse input of the operational amplifier 137 increases, and the output of the operational amplifier 137 forming the voltage follower also increases. As described above, the circuit 131 functions as a peak detection circuit.

A resistor 133 is a limiting resistor for liming so that an overcurrent may not flow to the diode 134, and a capacitor 136 is a holding capacitor. A resistor 135 is a discharging resistor for restoring a peak holding circuit to its initial state when the carrier is stopped, and the time constant of an RC circuit constituted by the resistor 135 and the capacitor 136 is selected so as to be sufficiently great relative to the period of the carrier.

In the other points, the construction of the communication in the present embodiment is the same as what has been described in the fourth embodiment.

The system as described above can read and write in non-contact with the nonvolatile memories of the interchangeable units, and is realized more inexpensively and enables the steps of effecting adjustment to be omitted. Further, even if there exists the irregularity of the output electric power due to the manufacturing irregularity of elements constituting the circuit and the pattern irregularity of the substrate, the signal amplitude of the channel greater in electric power than the standard can be adjusted in each channel and be kept within the standard by an automatic output adjusting circuit.

While in the above-described sixth embodiment, the radio frequency memories are ones attached to the four yellow, magenta, cyan and black toner containers, they may be radio frequency memories attached to other interchangeable parts than the toner containers. Further, the number of the radio frequency memories need not always be four. Also, in the above-described embodiments, the number of each of the communication IC and the amplification circuit is one, but if communication is effected with a plurality of memory units by a communication IC, a reduction in cost can be achieved, and for example, when communication is to be effected with a group of memory units greatly differing in position from one another, a plurality of communication IC's may be provided, and may be designed to effect communication with a plurality of nearby memory units.

In the communication part 400 which is the sixth embodiment, an amplification circuit variable in amplification factor is provided for a communication IC, and provision is made of a switch for changing over the amplified signal, and a circuit capable of automatically adjusting the amplitude of the amplified signal.

The amplification circuit acts to amplify the output of the memory control IC so that the electric power of the channel smallest in output may become electric power sufficient to be capable of communicating with the radio frequency memories. The switch acts to select the output of an amplification circuit from one of a plurality of channels. The automatic amplitude adjusting circuit can omit the trouble of adjusting the output amplitude because the adjustment of the output amplitude is automatically effected so that the output amplitude of the antenna may become such a predetermined amplitude that each channel does not exceed the standard of the Wireless Telegraphy Act or does not exceed the upper limit of the power source voltage made by the radio frequency memories.

The present invention can be applied to various recording systems such as the electrophotographic recording system and the electrostatic recording system. Also, the amplification circuit of FIG. 3, the receiving circuits of FIGS. 4 and 9, the amplification adjusting circuit of FIG. 8 and the automatic amplification adjusting circuit of FIG. 12 are examples of the circuit construction and are not restrictive. Accordingly, any of the receiving circuits of FIGS. 4 and 9 can be used in any of the above-described embodiments.

While the described embodiment represents the preferred form of the present invention, it is to be understood that modifications will occur to those skilled in that art without departing from the spirit of the invention. The scope of the invention is therefore to be determined solely by the appended claims.

What is claimed is:

1. An image forming apparatus on which a plurality of interchangeable units provided with nonvolatile memories are detachably mountable, comprising:

changeover means for changing over a plurality of communication signals based on non-contact type communication by an electromagnetic wave between the image forming apparatus and the nonvolatile memories of the interchangeable units to a different communication circuit; and communication means for controlling the changeover means to effect thereby the non-contact type communication among the nonvolatile memories of the interchangeable units, wherein the communication means has a plurality of amplifying means for amplifying the plurality of communication signals changed over to the different communication circuit by the changeover means.

2. An image forming apparatus according to claim 1, wherein the interchangeable units are units interchangeable according to life or consumption of a developing container or the like in which a developer is contained.

3. An image forming apparatus according to claim 1, wherein the communication means comprises:

a plurality of transmitting and receiving means for effecting transmission and reception of the plurality of communication signals with the nonvolatile memories of the interchangeable units; and second changeover means for changing over a reception signal received by each of the plurality of transmitting and receiving means.

4. An image forming apparatus according to claim 3, wherein the changeover means and the second changeover means include analog switches.

5. A communication controlling method applied to an image forming apparatus on which a plurality of interchangeable units provided with nonvolatile memories are detachably mountable, comprising:

a changing-over step, of changing over a plurality of communication signals based on non-contact type communication by an electromagnetic wave between a main body of the image forming apparatus and the nonvolatile memories of the interchangeable units to a different communication circuit; and a communicating step, of controlling performance of said changing-over step to effect thereby the non-contact type communication between the main body of the image forming apparatus and the nonvolatile memories of the interchangeable units, wherein the communicating step includes a plurality of amplifying steps, of amplifying the plurality of communication signals changed over to the different communication circuit in the changing-over step.

6. A communication controlling method according to claim 5, wherein the interchangeable units are units interchangeable according to life or consumption of a developing container or the like in which a developer is contained.

7. A communication controlling method according to claim 5, wherein the communicating step comprises:

a plurality of transmitting and receiving steps, of effecting transmission and reception of the plurality of communication signals between the interchangeable units and the nonvolatile memories; and a second changing-over step, of changing over a reception signal received in each of the plurality of transmitting and receiving steps.

8. A communication controlling method according to claim 7, wherein, in the changing-over step and the second changing-over step, the changing-over operation is performed by means of analog switches.

9. An image forming apparatus comprising:

a plurality of exposing systems each having a light emitting element and a light emitting element driving portion;

a plurality of image bearing bodies, adapted to be sensitized by the light energy of the light emitting elements, for forming electrostatic latent images thereon;

a plurality of image forming portions, adapted to control the exposing systems on a basis of printing data, thereby to form desired electrostatic latent images on the image bearing members, and to cause developers to adhere selectively to the electrostatic latent images on the image bearing members, thereby to form images;

a plurality of transferring portions, adapted to transfer the developer images to a transferring material, thereby to form images at one time or successively;

a fixing portion, adapted to fix the developers on the transferring material by heating or pressurizing after the plurality of images have been transferred to the transferring material; and communication means for effecting radio frequency type communication by an electromagnetic wave with nonvolatile memories mounted on units interchangeable according to the life or consumption thereof or developer containers, wherein the communication means includes:

amplifying means, provided for each signal controlling means, for controlling a communication signal;

switch means for selecting one of a plurality of communication circuits after the amplifying means amplifies the communication signal; and amplitude adjusting means for attenuating an amplitude of the communication signal passed through the switch means, wherein the communication means communicates with the plurality of nonvolatile memories by changing over said switch means, and wherein said amplitude adjusting means includes at least one resistor and at least one variable resistor.

10. An image forming apparatus comprising:

a plurality of exposing systems each having a light emitting element and a light emitting element driving portion;

a plurality of image bearing bodies, adapted to be sensitized by the light energy of the light emitting elements, for forming electrostatic latent images thereon;

a plurality of image forming portions, adapted to control the exposing systems on a basis of printing data, thereby to form desired electrostatic latent images on the image bearing members, and to cause developers to adhere selectively to the electrostatic latent images on the image bearing members, thereby to form images;

a plurality of transferring portions, adapted to transfer the developer images to a transferring material, thereby to form images at one time or successively;

a fixing portion, adapted to fix the developers on the transferring material by heating or pressurizing after the plurality of images have been transferred to the transferring material; and communication means for effecting radio frequency type communication by an electromagnetic wave with nonvolatile memories mounted on units interchangeable according to the life or consumption thereof or developer containers, wherein the communication means includes:

amplifying means, provided for each signal controlling means, for controlling a communication signal;

switch means for selecting one of a plurality of communication circuits after the amplifying means amplifies the communication signal; and amplitude adjusting means for attenuating an amplitude of the communication signal passed through the switch means, wherein the communication means communicates with the plurality of nonvolatile memories by changing over said switch means, and wherein the amplitude adjusting means includes a variable capacity capacitor connected in parallel with an inductor forming an antenna.

11. An image forming apparatus comprising:

a plurality of exposing systems each having a light emitting and a light emitting element driving portion;

a plurality of image bearing bodies, adapted to be sensitized by the light energy of the light emitting elements, for forming electrostatic latent images thereon;

a plurality of image forming portions, adapted to control the exposing systems on a basis of printing data, thereby to form desired electrostatic latent images on the image bearing members, and to cause developers to adhere selectively to the electrostatic latent images on the image bearing members, thereby to form images;

a plurality of transferring portions, adapted to transfer the developer images to a transferring material, thereby to form images at one time or successively;

a fixing portion, adapted to fix the developers on the transferring material by heating or pressurizing after the plurality of images have been transferred to the transferring material; and communication means for effecting radio frequency type communication by an electromagnetic wave with nonvolatile memories mounted on units interchangeable according to the life or consumption thereof or developer containers, wherein the communication means includes:

amplifying means, provided for each signal controlling means, for controlling a communication signal;

switch means for selecting one of a plurality of communication circuits after the amplifying means amplifies the communication signal; and automatic amplitude adjusting means for automatically adjusting an amplitude of the communication signal passed through the switch means to a predetermined value, wherein the communication communicates with the plurality of nonvolatile memories by changing over the switch means, and wherein automatic amplitude adjusting means includes:

a peak detection circuit, arranged to detect a peak level of a transmission signal;

a comparator, arranged to compare an output voltage of the peak detection circuit with a reference voltage; and an attenuation circuit of which an attenuation factor changes on a basis of an output voltage of the comparator.

12. An image forming apparatus on which a plurality of interchangeable units provided with nonvolatile memories are detachably mountable, comprising:

changeover means for changing over a plurality of communication signals based on non-contact type communication by an electromagnetic wave between the image forming apparatus and the nonvolatile memories of the interchangeable units to a different communication circuit; and communication means for controlling the changeover means, thereby to effect the non-contact type communication among the nonvolatile memories of the interchangeable units, wherein the communication means includes:

a plurality of transmitting and receiving means for effecting transmission and reception of the plurality of communication signals with the nonvolatile memories of the interchangeable units; and second changeover means for changing over a reception signal received by each of the plurality of transmitting and receiving means.

13. An image forming apparatus according to claim 12, wherein the changeover means and the second changeover means include analog switches.

14. A communication controlling method applied to an image forming apparatus on which a plurality of interchangeable units provided with nonvolatile memories are detachably mountable, comprising:

a changing-over step, of changing over a plurality of communication signals based on non-contact type communication by an electromagnetic wave between a main body of the image forming apparatus and the nonvolatile memories of the interchangeable units to a different communication circuit; and a communicating step, of controlling performance of said changing-over step to thereby effect the non-contact type communication between the main body of the image forming apparatus and the nonvolatile memories of the interchangeable units, wherein the communicating step includes:

a plurality of transmitting and receiving steps, of effecting transmission and reception of the plurality of communication signals between the interchangeable units and the nonvolatile memories; and a second changing-over step, of changing over a reception signal received in each of the plurality of transmitting and receiving steps.

15. A communication controlling method according to claim 14, wherein, in the changing-over step and the second changing-over step, the changing-over operation is performed by means of analog switches.

16. An image forming apparatus on which a plurality of interchangeable units provided with nonvolatile memories are detachably mountable, the interchangeable units including at least one or both of development means and a developer container, the image forming apparatus comprising:

a plurality of communication means for effecting radio frequency type communication with the nonvolatile memories by an electromagnetic wave;

amplifying means, commonly used in association with the plurality of communication means, for amplifying a data signal to be transmitted to make an amplified data signal;

switch means for selectively outputting the amplified data signal to one of the plurality of communication means; and amplitude adjusting means including at least one resistor and at least one variable resistor and being pre-positioned at the plurality of the communication means, for attenuating an amplitude of the data signal to be transmitted, wherein the image forming apparatus communicates with a plurality of the nonvolatile memories by changing the switch means.

17. An image forming apparatus on which a plurality of interchangeable units provided with nonvolatile memories are detachably mountable, the interchangeable units including at least one or both of development means and a developer container, the image forming apparatus comprising:

a plurality of communication means for effecting radio frequency type communication with the nonvolatile memories by an electromagnetic wave;

amplifying means, commonly used in association with the plurality of communication means, for amplifying a data signal to be transmitted to make an amplified data signal; and switch means for selectively outputting the amplified data signal to one of the plurality of communication means, wherein the communication means includes an inductor serving as an antenna, wherein the image forming apparatus includes a plurality of amplitude adjusting means for attenuating an amplitude of the data signal passed through the switch means with a variable capacitor connected in parallel with the inductor, the plurality of amplitude adjusting means being pre-positioned at the plurality of the communication means, and wherein the image forming apparatus communicates with a plurality of the nonvolatile memories by changing the switch means.

18. An image forming apparatus on which a plurality of interchangeable units provided with nonvolatile memories are detachably mountable, the interchangeable units including at least one or both of development means and a developer container, the image forming apparatus comprising:

a plurality of communication means for effecting radio frequency type communication with the nonvolatile memories by an electromagnetic wave;

amplifying means, commonly used in association with the plurality of communication means, for amplifying a data signal to be transmitted to make an amplified data signal;

switch means for selectively outputting the amplified data signal to one of the plurality of communication means; and automatic amplitude adjusting means for automatically adjusting an amplitude of the data signal passed through the switch means to a predetermined value, wherein the automatic amplitude adjusting means includes:

a peak detecting circuit, pre-positioned at the plurality of the communication means, to detect a peak level of the data signal passed through the switch means;

a comparator, arranged to compare an output voltage of the peak detection circuit with a reference voltage; and an attenuation circuit of which an attenuation factor changes on a basis of an output voltage of the comparator, and wherein the image forming apparatus communicates with a plurality of the nonvolatile memories by changing the switch means.

19. An image forming apparatus on which a plurality of interchangeable units provided with nonvolatile memories are detachably mountable, comprising:

a data signal control unit configured to generate a data signal to the transmitted to the nonvolatile memories of each of the interchangeable units;

a plurality of communication units configured to communicate with the nonvolatile memories of respective ones of the interchangeable units; and a first selector configured to connect one of the plurality of communication units with said data signal control unit, selectively, wherein each of the communication units has an amplifier configured to amplify the data signal from said first selector.

20. An image forming apparatus according to claim 19, wherein each of the interchangeable units contains developer and is to be replaced with a new unit when a life term of use of the unit to be replaced has passed or the developer in the unit to be replaced is consumed.

21. An image forming apparatus according to claim 19, wherein said apparatus comprises a second selector configured to connect one of said plurality of communication units with the data signal control unit, selectively, so as to supply a data signal received by the selected communication unit to said data signal control unit.

22. An image forming apparatus according to claim 21, wherein the first and the second selectors each include at least one respective analog switch.

23. An image forming apparatus on which a plurality of interchangeable units provided with nonvolatile memories are detachably mountable, the interchangeable units including at least one or both of a developing unit and a developer container, the image forming apparatus comprising:

a plurality of communication units configured to effect radio frequency type communication with the nonvolatile memories by means of electromagnetic waves;

an amplifier, used in common in association with the plurality of communication units, configured to amplify a data signal to be supplied to one of said plurality of communication units; and a first selector configured to output the amplified data signal to one of the plurality of communication units, selectively, wherein each of the communication means includes an amplitude adjuster including at least one resistor and at least one variable resistor configured to attenuate an amplitude of the data signal to be transmitted, and wherein the image forming apparatus communicates with a desired one of a plurality of the nonvolatile memories of the interchangeable units by selecting the communication unit corresponding to said desired nonvolatile memory of the interchangeable unit.

24. An image forming apparatus on which a plurality of interchangeable units provided with nonvolatile memories are detachable mountable, the interchangeable units including at least one or both of a developing unit and a developer container, the image forming apparatus comprising:

a plurality of communication units configured to effect radio frequency type communication with the nonvolatile memories by means of electromagnetic waves;

an amplifier, used in common in association with the plurality of communication units, configured to amplify a data signal to be supplied to one of said plurality of communication units; and a first selector configured to output the amplified data signal to one of the plurality of communication units, selectively, wherein each of the communication means includes an inductor serving as an antenna and a variable capacitor connected in parallel with the inductor and is configured to attenuate an amplitude of the data signal which has been passed through the first selector, and wherein the image forming apparatus communicates with a desired one of a plurality of the nonvolatile memories of the interchangeable units by selecting the communication unit corresponding to said desired nonvolatile memory of the interchangeable unit.

25. An image forming apparatus on which a plurality of interchangeable units provided with nonvolatile memories are detachably mountable, the interchangeable units including at least one or both of a developing unit and a developer container, the image forming apparatus comprising:

a plurality of communication units configured to effect radio frequency type communication with the nonvolatile memories by means of electromagnetic waves;

an amplifier, used in common in association with the plurality of communication units, configured to amplify a data signal to be transmitted; and a first selector configured to output the amplified data signal to one of the plurality of communication units, selectively, wherein each of the communication units includes an automatic amplitude adjuster configured to perform automatic adjustment of an amplitude of the data signal which has passed through the first selector to a predetermined value, and wherein the image forming apparatus communicates with a desired one of a plurality of the nonvolatile memories of the interchangeable units by selecting the communication unit corresponding to said desired nonvolatile memory of the interchangeable unit.

26. An image forming apparatus according to claim 23, further comprising:

a plurality of exposing systems each having a light emitting element and a light emitting element driving portion;

a plurality of image bearing bodies, adapted to be sensitized by light energy from the light emitting element, for forming electrostatic latent images thereon;

a plurality of image developing portions, adapted to cause developer to adhere selectively to the electrostatic latent images on the image bearing members, thereby to form developer images;

a plurality of transferring portions, adapted to transfer the developer images to a transferring material successively; and a fixing portion, adapted to fix the developer on the transferring material by heating or pressurizing after the plurality of images have been transferred to the transferring material.

27. An image forming apparatus according to claim 24, further comprising:

a plurality of exposing systems each having a light emitting element and a light emitting element driving portion;

a plurality of image bearing bodies, adapted to be sensitized by light energy from the light emitting elements, for forming electrostatic latent images thereon;

a plurality of image developing portions, adapted to cause developers to adhere selectively to the electrostatic latent images on the image bearing members, thereby to form developer images;

a plurality of transferring portions, adapted to transfer the developer images to a transferring material successively; and a fixing portion adapted to fix the developer on the transferring material by heating or pressurizing after the plurality of images have been transferred to the transferring material.

28. An image forming apparatus according to claim 25, further comprising:

a plurality of exposing systems each having a light emitting and a light emitting element driving portion;

a plurality of image bearing bodies, adapted to be sensitized by light energy of the light emitting elements, for forming electrostatic latent images thereon;

a plurality of image developing portions, adapted to cause developers to adhere selectively to the electrostatic latent images on the image bearing members, thereby to form developer images;

a plurality of transferring portions, adapted to transfer the developer images to a transferring material successively; and a fixing portion, adapted to fix the developer on the transferring material by heating or pressurizing after the plurality of images have been transferred to the transferring material.

29. An image forming apparatus on which a plurality of interchangeable units provided with nonvolatile memories are detachably mountable, comprising:

a data signal control unit configured to input/output a data signal transmitted from/to any of the nonvolatile memories of the interchangeable units;

a plurality of communication units configured to communicate with the nonvolatile memories of respective ones of the interchangeable units;

a first selector configured to connect one of the plurality of communication units with said data signal control unit, selectively, so as to supply a data signal output from said data signal control unit to the selected communication unit; and a second selector configured to connect one of said plurality of communication units with said data signal control unit, selectively, so as to supply a data signal received by the selected communication unit to said data signal control unit.

30. An image forming apparatus according to claim 29, wherein the first and the second selectors each include a respective analog switch.

31. An image forming apparatus according to claim 25, wherein the automatic amplitude adjusting means includes:

a peak detecting circuit configured to detect a peak level of the data signal which has passed through the first selector;

a comparator, ranged to compare an output voltage of the peak detection circuit with a reference voltage; and an attenuation circuit of which an attenuation factor changes based on an output voltage of the comparator.

32. An image forming apparatus on which a plurality of interchangeable units provided with nonvolatile memories are detachably mountable, comprising:

a data signal control unit configured to generate a data signal to be transmitted to any of the nonvolatile memories of the interchangeable units;

a plurality of communication units configured to effect a communication with respective ones of the nonvolatile memories;

an amplifier, used in common in association with the plurality of communication units, configured to amplify a data signal to be transmitted;

a first selector configured to output the amplified data signal to one of the plurality of communication units, selectively, wherein each of the communication units includes an inductor serving as an antenna and a capacitor connected in parallel with the inductor and is operable with a capacitance value of said capacitor being suitable and different for each communication unit, and wherein the image forming apparatus communicates with a desired one of the plurality of the nonvolatile memories of the interchangeable units by selecting the communication unit corresponding to said desired nonvolatile memory of the interchangeable unit.

33. An image forming apparatus according to claim 32, wherein each of the interchangeable units contains developer and is to be replaced with a new unit when a life term of use of the unit to be replaced has passed or the developer in the unit to be replaced is consumed.

34. An image forming apparatus according to claim 32, wherein said apparatus comprises a second selector configured to connect one of said plurality of communication units with the data signal control unit, selectively, so as to supply a data signal received by the selected communication unit to said data. signal control unit.

35. An image forming apparatus according to claim 32, wherein the first and the second selectors each include a respective analog switch.

36. An image forming apparatus according to claim 28, wherein each of the interchangeable units contains developer and is to be replaced with a new unit when a life term of use of the unit to be replaced has passed or the developer in the unit to be replaced is consumed.

37. An image forming apparatus according to claim 23, wherein each of the interchangeable units contains developer and is to be replaced with a new unit when a life term of use of the unit to be replaced has passed or the developer in the unit to be replaced is consumed.

38. An image forming apparatus according to claim 23, wherein said apparatus comprises a second selector configured to connect one of said plurality of communication units selectively with the data signal control unit so as to supply a data signal received by the selected communication unit to said data signal control unit.

39. An image forming apparatus according to claim 23, wherein the first and the second selectors each include a respective analog switch.

40. An image forming apparatus according to claim 24, wherein each of the interchangeable units contains developer and is to be replaced with a new unit when a life term of use of the unit to be replaced has passed or the developer in the unit to be replaced is consumed.

41. An image forming apparatus according to claim 24, wherein said apparatus comprises a second selector configured to connect one of said plurality of communication units selectively with the data signal control unit so as to supply a data signal received by the selected communication unit to said data signal control unit.

42. An image forming apparatus according to claim 24, wherein the first and the second selectors each include a respective analog switch.

43. An image forming apparatus according to claim 25, wherein each of the interchangeable units contains developer and is to be replaced with a new unit when a life term of use of the unit to be replaced has passed or the developer in the unit to be replaced is consumed.

44. An image forming apparatus according to claim 25, wherein said apparatus comprises a second selector configured to connect one of said plurality of communication units selectively with the data signal control unit so as to supply a data signal received by the selected communication unit to said data signal control unit.

45. An image forming apparatus according to claim 25, wherein the first and the second selectors each include a respective analog switch.

* * * * *

UNITED STATES PATENT AND TRADEMARK OFFICE

CERTIFICATE OF CORRECTION

PATENT NO. : 6,665,501 B2
DATED : December 16, 2003
INVENTOR(S) : Tomoyuki Okada et al.

It is certified that error appears in the above-identified patent and that said Letters Patent is hereby corrected as shown below:

Title page,
Item [56], References Cited, FOREIGN PATENT DOCUMENTS, "1-39717" should read -- 10-39717 --.

Column 2,
Line 63, "than before the exhaustion of" should be deleted; and
Line 64, "the toner is reported," should be deleted.

Column 3,
Line 4, "are" should read -- is --; and
Line 10, "other" should read -- another --.

Column 13,
Line 56, "desonance" should read-- resonance --.

Column 17,
Line 51, "too" should read -- much --.

Column 25,
Line 33, "detachable" should read -- detachably --.

Column 27,
Line 33, "ranged" should read -- arranged --.

Column 28,
Line 11, "data." should read -- data --.

Signed and Sealed this

Twelfth Day of October, 2004

JON W. DUDAS
*Director of the United States Patent and Trademark Office*